US011598291B2

(12) United States Patent
Hidai et al.

(10) Patent No.: US 11,598,291 B2
(45) Date of Patent: Mar. 7, 2023

(54) STRADDLED VEHICLE

(71) Applicant: YAMAHA HATSUDOKI KABUSHIKI KAISHA, Iwata (JP)

(72) Inventors: Atsuya Hidai, Shizuoka (JP); Hisatoshi Kinoshita, Shizuoka (JP); Kazuteru Iwamoto, Shizuoka (JP); Atsushi Hirano, Shizuoka (JP); Tatsuya Kasahara, Shizuoka (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 0 days.

(21) Appl. No.: 17/828,008

(22) Filed: May 30, 2022

(65) Prior Publication Data

US 2022/0389888 A1 Dec. 8, 2022

(30) Foreign Application Priority Data

May 31, 2021 (JP) ..... JP2021-091963

(51) Int. Cl.
*F02M 25/08* (2006.01)
*F02B 61/02* (2006.01)

(52) U.S. Cl.
CPC .... *F02M 25/0809* (2013.01); *F02M 25/0836* (2013.01); *F02B 61/02* (2013.01)

(58) Field of Classification Search
CPC ..... F02M 25/0836; F02M 25/0872; F02M 25/089
See application file for complete search history.

(56) References Cited

U.S. PATENT DOCUMENTS

2006/0037584 A1* 2/2006 Imamura ..... F02M 35/14 123/472
2014/0060955 A1* 3/2014 Kono ..... F02M 35/024 180/291
2016/0009329 A1* 1/2016 Tsubone ..... B62J 37/00 180/219
2016/0010599 A1* 1/2016 Tsubone ..... F02M 25/0854 123/520
2016/0245237 A1* 8/2016 Ono ..... F02M 25/089
(Continued)

FOREIGN PATENT DOCUMENTS

WO 2020184226 A1 9/2020

*Primary Examiner* — Phutthiwat Wongwian
*Assistant Examiner* — Anthony L Bacon
(74) *Attorney, Agent, or Firm* — Rabin & Berdo, P.C.

(57) ABSTRACT

A gas-leak-detection device for detecting a gas leakage from an evaporative emission system includes an electric-wire-connection portion and a passage connection portion that are disposed to overlap with at least one of appearance components in a vehicle when the vehicle is seen in a viewing direction, and are disposed closer to the at least one appearance component than a center plane perpendicular to the viewing direction when the vehicle is in an upright state, the center plane being one of an imaginary-lateral-center plane that is an imaginary vertical plane perpendicular to the left-right direction, an imaginary-longitudinal-center plane that is an imaginary vertical plane including a center in the front-rear direction and being perpendicular to the front-rear direction, or an imaginary-vertical-center plane that is an imaginary horizontal plane including a center in the top-bottom direction and being perpendicular to the top-bottom direction.

6 Claims, 16 Drawing Sheets

(56) References Cited

U.S. PATENT DOCUMENTS

| | | | | |
|---|---|---|---|---|
| 2018/0179992 | A1* | 6/2018 | Morita | F02M 25/089 |
| 2019/0329647 | A1* | 10/2019 | Takata | F02M 25/0854 |
| 2020/0018247 | A1* | 1/2020 | Shinagawa | F02D 41/003 |
| 2020/0102899 | A1* | 4/2020 | Andrzejewski | F02M 25/0854 |
| 2021/0003101 | A1* | 1/2021 | Edwards | F02M 25/089 |

* cited by examiner or or

STRADDLED VEHICLE

TECHNICAL FIELD

The present teaching relates to a straddled vehicle.

BACKGROUND ART

A straddled vehicle using an engine as a power source, such as a motorcycle, includes an evaporative emission system for collecting evaporation fuel in order to suppress emission, to the air, evaporation fuel obtained by vaporization of fuel in a fuel tank. The evaporative emission system includes a canister connected to the fuel tank and an intake passage of the engine through a purge pipe. The evaporative emission system causes the evaporation fuel that has flowed from the fuel tank into the canister through the purge pipe to be adsorbed onto activated carbon in the canister. The evaporative emission system discharges the evaporation fuel onto which the activated carbon is adsorbed to the intake passage of the engine together with outside air introduced from an outside-air-introduction passage. The evaporation fuel discharged from the evaporative emission system into the intake passage of the engine is burnt by the engine.

A volume of the canister necessary for collecting the evaporation fuel using activated carbon is determined based on the amount of generation of evaporation fuel calculated from, for example, the volume of the fuel tank and the area of a liquid level of fuel. Thus, the volume of the canister increases as the volume of the fuel tank and the area of the liquid level of fuel, for example, increase. On the other hand, in a straddled vehicle such as a motorcycle, a large number of components such as an engine and an auxiliary machine for the engine are mounted within a limited space. The canister is mounted in the limited space of the straddled vehicle together with other components while maintaining a volume sufficient for collecting evaporation fuel.

Patent Document 1, for example, discloses a straddled vehicle in which a canister is disposed between a body frame and an engine and located above a fuel pump. The canister is fixed to the body frame through a support member shared by the fuel pump. In the straddled vehicle of Patent Document 1, the canister and the fuel pump are vertically disposed near the engine so that components for the fuel system can be arranged in a compact space.

CITATION LIST

Patent Document

Patent Document 1: WO2020/184226

SUMMARY OF INVENTION

Technical Problem

The evaporative emission system needs to be air-tight in order to prevent leakage of evaporation fuel to the outside. In view of this, it is required in the straddled vehicle to regularly conduct a leak test for determining whether the evaporative emission system is air-tight enough to prevent leakage of evaporation fuel to the outside. Air tightness of the evaporative emission system is, for example, determined based on a pressure in a gas passage of the evaporative emission system when a gas in the air passage is sucked with an outside-air-introduction passage closed.

To perform a leak test of a gas from the evaporative emission system, the straddled vehicle has to further include, for example, an electric vent valve for blocking an outside-air-introduction passage of the canister, an electric suction pump for sucking a gas in the gas passage, and a pressure sensor for measuring a pressure in the gas passage. Components for a leak test of a gas from the evaporative emission system are connected to, for example, a pipe constituting the gas passage through a passage connection portion. In addition, the component for a leak test of a gas from the evaporative emission system is connected to an electric wire for supplying electric power through an electric-wire-connection portion.

A vehicle body of the straddled vehicle can be splashed with rain water during driving and sprayed with, for example, high-pressure wash water in washing the straddled vehicle at high pressure in some cases. Thus, the component for a leak test of a gas from the evaporative emission system can also be splashed with, for example, rain water during driving and high-pressure wash water during high-pressure vehicle wash. In view of this, to drive the component for a leak test of a gas from the evaporative emission system normally, the passage connection portion and the electric-wire-connection portion need to be waterproof.

It is therefore an object of the present teaching to provide a straddled vehicle in which components for a leak test of a gas from an evaporative emission system are arranged to enhance waterproofness of passage connection portions and electric-wire-connection portions of these components.

Solution to Problem

Inventors of the present teaching have studied a straddled vehicle in which components for a leak test of a gas from an evaporative emission system are arranged to enhance waterproofness of passage connection portions and electric-wire-connection portions of these components. Through an intensive study, the inventors have reached the following configuration.

A straddled vehicle according to one embodiment of the present teaching includes: a plurality of appearance components constituting appearance of the straddled vehicle; a front wheel; a rear wheel; a bar handle configured to steer the front wheel; an engine configured to drive the front wheel or the rear wheel; a fuel tank configured to store fuel to be supplied to the engine; and an evaporative emission system configured to collect evaporation fuel generated in the fuel tank by using a canister, to introduce outside air into the canister from an outside-air-introduction passage for introducing outside air, and to discharge the collected evaporation fuel and the introduced outside air from the canister into an intake passage of the engine.

The straddled vehicle also includes: a pressure sensor outside-air-introduction passage configured to measure a pressure in a gas passage in the evaporative emission system, the gas passage including the outside-air-introduction passage and a gas including at least one of the evaporation fuel or the outside air flowing in the gas passage; and at least one of an electric vent valve or an electric suction pump, the electric vent valve being configured to switch between a closed state in which the outside-air-introduction passage is closed and an open state in which the outside-air-introduction passage is open, the electric suction pump being configured to suck a gas in the gas passage. Each of at least one of the vent valve or the suction pump and the pressure sensor includes an electric-wire-connection portion to which an electric wire for supplying electric power is connected, and a passage connection portion to which the gas passage is connected.

Each of at least one of the vent valve or the suction pump and the pressure sensor is disposed in the straddled vehicle such that the electric-wire-connection portion and the passage connection portion overlap with at least one of the plurality of appearance components when the straddled vehicle is seen in at least one viewing direction that is at least one of a left-right direction, a front-rear direction, or a top-bottom direction. Each of at least one of the vent valve or the suction pump and the pressure sensor is disposed in the straddled vehicle such that the electric-wire-connection portion and the passage connection portion are located closer to the appearance component overlapping with the electric-wire-connection portion and the passage connection portion than a center plane perpendicular to the viewing direction in the straddled vehicle in an upright state, the center plane being one of an imaginary-lateral-center plane that is an imaginary vertical plane including a center of the bar handle in the left-right direction and being perpendicular to the left-right direction, an imaginary-longitudinal-center plane that is an imaginary vertical plane including a center in the front-rear direction between a front end of the front wheel and a rear end of the rear wheel and being perpendicular to the front-rear direction, or an imaginary-vertical-center plane that is an imaginary horizontal plane including a center in the top-bottom direction between an upper end of the bar handle and a lower end of the front wheel and being perpendicular to the top-bottom direction.

In the configuration described above, in each of at least one of the vent valve or the suction pump included in the straddled vehicle and the pressure sensor, the electric-wire-connection portion to which the electric wire is connected and the passage connection portion to which the gas passage is connected are covered with the appearance component when the straddled vehicle is seen in at least one viewing direction of the left-right direction, the front-rear direction, or the top-bottom direction that is a direction in which the straddled vehicle is seen from a surrounding thereof. The electric-wire-connection portion and the passage connection portion are disposed closer to the appearance component than a center plane that is perpendicular to the viewing direction and is one of the imaginary-lateral-center plane, the imaginary-longitudinal-center plane, or the imaginary-vertical-center plane. Thus, the electric-wire-connection portion and the passage connection portion are less likely to be splashed with, for example, rain water during driving of the straddled vehicle and high-pressure wash water during high-pressure vehicle wash. In addition, since the vent valve that opens the outside-air-introduction passage is covered with the appearance component, rain water and wash water, for example, are less likely to enter from the outside-air-introduction passage. Thus, components for a leak test of a gas from the evaporative emission system can be arranged to enhance waterproofness of the passage connection portions and the electric-wire-connection portions of the components.

In addition, the electric-wire-connection portions and the passage connection portions are covered with the appearance component and are disposed close to the appearance component. Thus, the amount of application of ultraviolet radiation included in sunlight can be reduced. Consequently, light fastness of the electric-wire-connection portions and the passage connection portions can be enhanced.

In another aspect, the straddled vehicle according to the present teaching preferably has the following configuration. The plurality of appearance components include a first appearance component and a second appearance component, and the first appearance component and the second appearance component are disposed such that a gap is formed between the first appearance component and the second appearance component.

In the configuration described above, the gap is disposed between the first appearance component and the second appearance component. Even in the case where the gap is disposed between the first appearance component and the second appearance component, since the electric-wire-connection portion and the passage connection portion overlap with at least one of the plurality of appearance components when seen in the viewing direction, at least one of the vent valve or the suction pump included in the straddled vehicle and the pressure sensor are less likely to be splash with water.

In another aspect, the straddled vehicle according to the present teaching preferably has the following configuration. The straddled vehicle further includes a side stand configured to support the straddled vehicle such that the straddled vehicle stands by itself in a lean state, and each of at least one of the vent valve or the suction pump and the pressure sensor is disposed in the straddled vehicle such that the electric-wire-connection portion and the passage connection portion overlap with at least one of the plurality of appearance components when the straddled vehicle is seen in at least one viewing direction that is at least one of a left-right direction, a front-rear direction, or a top-bottom direction in a state where the straddled vehicle stands by itself by the side stand.

In the configuration described above, in the state where the straddled vehicle stands by itself by the side stand, the electric-wire-connection portion and the passage connection portion are also covered with the appearance component when the straddled vehicle is seen in at least one viewing direction that is at least one of the left-right direction, the front-rear direction, or the top-bottom direction, and are disposed close to the appearance component. Thus, in the state where the straddled vehicle stands by itself by the side stand, the electric-wire-connection portion and the passage connection portion are less likely to be splashed with, for example, high-pressure wash water during high-pressure vehicle wash. Thus, at least one of the vent valve or the suction pump and the pressure sensor can be disposed to enhance waterproofness of the electric-wire-connection portions and the passage connection portions.

In another aspect, the straddled vehicle according to the present teaching preferably has the following configuration. At least one of the vent valve, the suction pump, or the pressure sensor is supported to at least one of the plurality of appearance components by a support member.

In the configuration described above, components for a leak test of a gas from the evaporative emission system are supported to the appearance component by the support member to be thereby disposed closer to the appearance component. Accordingly, it is possible for the appearance component to further ensure protection of the electric-wire-connection portion and the passage connection portion against, for example, rain water during driving and high-pressure wash water during high-pressure vehicle wash. Thus, the electric-wire-connection portion and the passage connection portion are less likely to be splashed with, for example, rain water during driving of the straddled vehicle and high-pressure wash water during high-pressure vehicle wash. As a result, components for a leak test of a gas from the evaporative emission system can be disposed to enhance waterproofness of the passage connection portions and the electric-wire-connection portions of the components.

In another aspect, the straddled vehicle according to the present teaching preferably has the following configuration. The electric-wire-connection portion is connected to the electric wire by using a connection terminal configured to suppress entering of liquid from the outside. The passage connection portion is connected to the gas passage by using a hermetic member configured to suppress entering of liquid from the outside.

In the configuration described above, the electric-wire-connection portion and the passage connection portion of each component for a leak test of a gas from the evaporative emission system have air tightness. In the straddled vehicle, the appearance component covers the electric-wire-connection portion and the passage connection portion so that the component for a leak test of a gas from the evaporative emission system can be disposed to further enhance waterproofness of the passage connection portion and the electric-wire-connection portion of the component.

In another aspect, the straddled vehicle according to the present teaching preferably has the following configuration. In a case where the straddled vehicle includes the vent valve, the pressure sensor measures a pressure in the gas passage in a state where the outside-air-introduction passage is closed by the vent valve. In another case where the straddled vehicle includes the suction pump and the suction pump is disposed in the outside-air-introduction passage that is a part of the gas passage, the suction pump sucks a gas in the gas passage, the pressure sensor measures a pressure in the gas passage, and leakage of a gas from the evaporative emission system is detected. In another case where the straddled vehicle includes the vent valve and the suction pump, the suction pump sucks a gas in the gas passage, the pressure sensor measures a pressure in the gas passage, and leakage of a gas from the evaporative emission system is detected in a state where the outside-air-introduction passage is closed by the vent valve.

With the configuration described above, in the straddled vehicle, a leak test of a gas from the evaporative emission system is performed with the electric-wire-connection portion and the passage connection portion covered with the appearance component. As a result, components for a leak test of a gas from the evaporative emission system can be disposed to enhance waterproofness of the passage connection portions and the electric-wire-connection portions of the components.

The terminology used herein is for the purpose of describing particular embodiments only and is not intended to be limiting of the invention.

As used herein, the term "and/or" includes any and all combinations of one or more of the associated listed items.

It will be further understood that the terms "including," "comprising" or "having" and variations thereof when used in this specification, specify the presence of stated features, steps, operations, elements, components, and/or their equivalents but do not preclude the presence or addition of one or more other features, steps, operations, elements, components, and/or groups thereof.

It will be further understood that the terms "mounted," "connected," "coupled," and/or their equivalents are used broadly and encompass both direct and indirect mounting, connecting and coupling. Further, "connected" and "coupled" are not restricted to physical or mechanical connections or couplings, and can include electrical connections or couplings, whether direct or indirect.

Unless otherwise defined, all terms (including technical and scientific terms) used herein have the same meaning as commonly understood by one having ordinary skill in the art to which this invention belongs.

It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques.

Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

An embodiment of a straddled vehicle according to the present teaching will be herein described.

In the following description, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

[Straddled Vehicle]

A straddled vehicle herein is a vehicle in which a passenger is seated on a seat while being astride the seat. Thus, the straddled vehicle includes vehicles such as a three-wheeled vehicle and a four-wheeled vehicle in addition to a two-wheeled vehicle as long as a passenger is seated on a seat while being astride the seat. The straddled vehicle may be a single-passenger vehicle or a vehicle on which a plurality of passengers can ride. The straddled vehicle includes a scooter.

[Integrated with Canister]

The expression of "integrated with a canister" refers to a state where a component is fixed to a canister at a relatively short distance from the canister. The short distance only needs to be at a distance smaller than a maximum length of the canister and a maximum length of a component integrated with the canister. The short distance may be a distance smaller than the maximum length of the canister. A procedure and a method for integrating the canister and a component to be integrated with the canister are not specifically limited.

[Evaporation Fuel]

An evaporation fuel herein refers to fuel obtained by vaporization of hydrocarbon fuel such as gasoline or gas oil serving as fuel of the straddled vehicle under the influence of, for example, temperature and atmospheric pressure.

[Appearance Component]

An appearance component herein refers to a component that is at least partially visually recognized when the straddled vehicle is seen in the top-bottom direction, the left-right direction, or the front-rear direction. Examples of the appearance component include a cover, a seat, a headlight, a meter, a taillight, a tank cover, a dummy tank, and a pannier case located at the outer surface of the straddled vehicle to surround the vehicle body of the straddled vehicle.

The appearance component also includes, for example, a main frame, a fuel tank, and a rear arm having a large surface area that can be visually recognized.

[Imaginary-Lateral-Center Plane]

An imaginary-lateral-center plane herein refers to an imaginary vertical plane including a center of a bar handle in the left-right direction and being perpendicular to the lateral direction in an upright state of a straddled vehicle. That is, the imaginary-lateral-center plane refers to an imaginary vertical plane that divides the straddled vehicle into a right half and a left half in the left-right direction when the straddled vehicle is seen in the vertical direction, in the upright state of the straddled vehicle.

[Imaginary-Longitudinal-Center Plane]

An imaginary-longitudinal-center plane herein refers to an imaginary vertical plane including a center in the front-rear direction between the front end of a front wheel and the rear end of a rear wheel and being perpendicular to the longitudinal direction. That is, the imaginary-longitudinal-center plane refers to an imaginary vertical plane that divides the straddled vehicle into a front half and a rear half in the front-rear direction when the straddled vehicle is seen in the vertical direction, in the upright state of the straddled vehicle.

[Imaginary-Vertical-Center Plane]

An imaginary-vertical-center plane herein refers to an imaginary horizontal plane including a center in the top-bottom direction between the upper end of the bar handle and the lower end of the front wheel and being perpendicular to the top-bottom direction in the upright state of the straddled vehicle. That is, the imaginary-vertical-center plane refers to an imaginary horizontal plane that divides the straddled vehicle except for a mirror into an upper half and a lower half in the top-bottom direction when the straddled vehicle is seen in the horizontal direction, in the upright state of the straddled vehicle.

[Gas Passage]

A gas passage herein refers to a passage in which at least one of evaporation fuel or outside air passes in the evaporative emission system. The gas passage includes a space in which evaporation fuel in an upstream purge pipe coupling the fuel tank and the canister to each other passes, a space in which evaporation fuel and outside air in a downstream purge coupling the canister and an intake pipe of the engine to each other pass, a purge pipe as an outside-air-introduction passage for introducing outside air, and a space in which evaporation fuel and outside air pass in the canister. In the gas passage, activated carbon for capturing evaporation fuel is disposed.

[Relative Distance]

A relative distance herein refers to a distance between barycenters of integrated components.

[Viewing Direction]

A viewing direction herein refers to a direction when the straddled vehicle is seen from a surrounding of the straddled vehicle. The top-bottom direction in the viewing direction is a vertical direction. The front-rear direction in the viewing direction has a horizontal component of an imaginary line passing through the front end of the front wheel and the rear end of the rear wheel of the straddled vehicle. The left-right direction in the viewing direction is a direction perpendicular to the top-bottom direction and the front-rear direction.

Advantageous Effects of Invention

According to one embodiment of the present teaching, it is possible to provide a straddled vehicle on which components for a leak test of a gas from an evaporative emission system can be arranged to enhance waterproofness of a passage connection portions and an electric-wire-connection portions of the components.

DESCRIPTION OF EMBODIMENT

Figure 1:
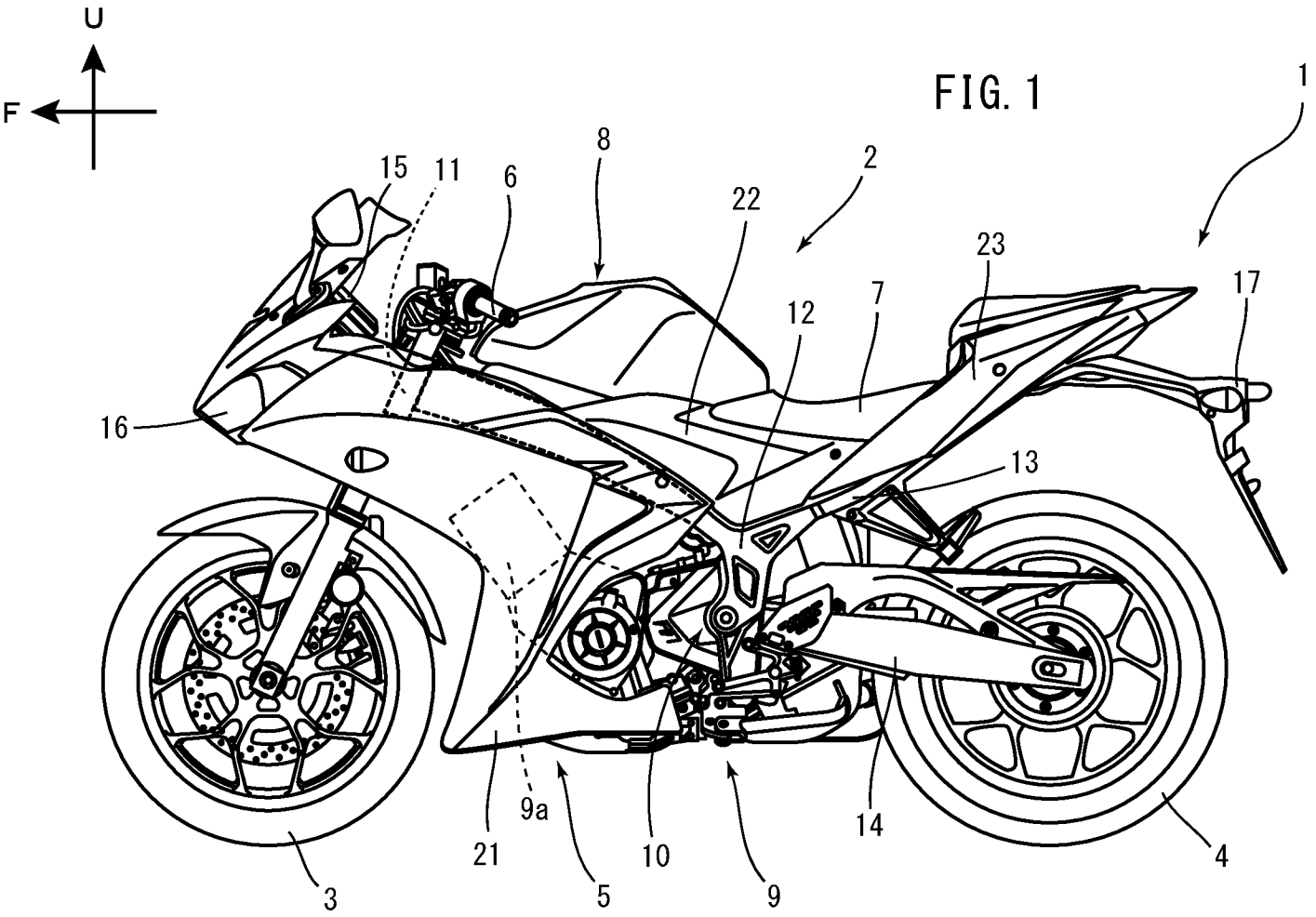
FIG. 1 is a side view schematically illustrating an entire configuration of a straddled vehicle according to an embodiment of the present teaching.

Each embodiment of the present teaching will be described in detail with reference to the drawings. In the drawings, the same or corresponding parts are denoted by the same reference numerals, and description thereof will not be repeated. The dimensions of components in the drawings do not strictly represent actual dimensions of the components and dimensional proportions of the components.

In the following description, arrow F in the drawings represents a forward direction of a vehicle. Arrow U in the drawings represents an upward direction of the vehicle. Arrow L in the drawings represents a leftward direction of the vehicle. Arrow R in the drawings represents a rightward direction of the vehicle. The front-rear direction and the left-right direction herein respectively refer to the front-rear direction and the left-right direction when seen from a passenger driving the vehicle.

First Embodiment

<Overall Configuration of Straddled Vehicle>

Figure 2:
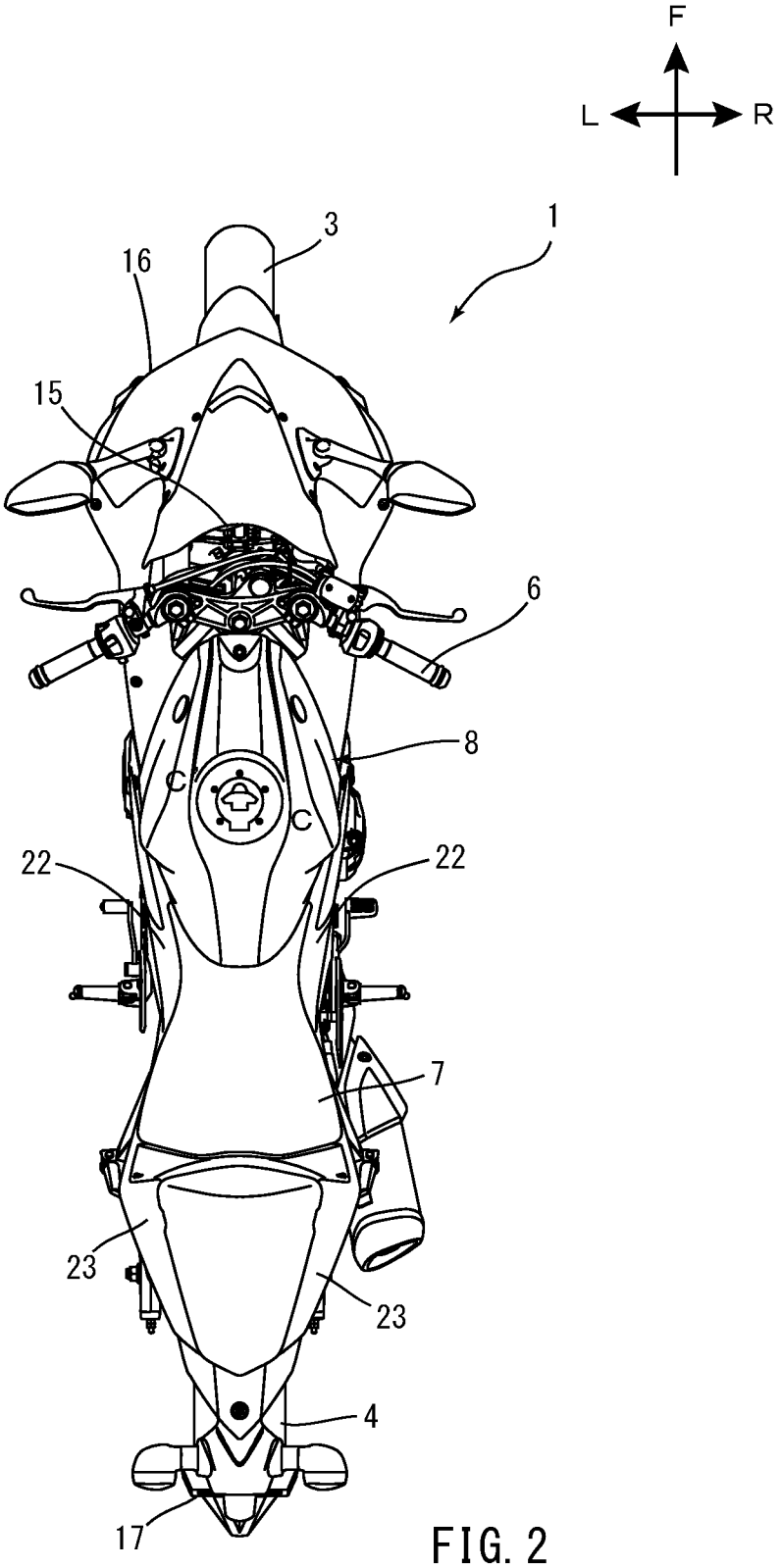
FIG. 2 is a plan view schematically illustrating the entire configuration of the straddled vehicle according to the embodiment of the present teaching.

With reference to FIGS. 1 and 2, a vehicle 1 as a straddled vehicle according to the present teaching will be described. FIG. 1 is a side view schematically illustrating an overall configuration of the vehicle 1 according to an embodiment. FIG. 2 is a plan view schematically illustrating an overall configuration of the vehicle 1 according to the embodiment. The vehicle 1 is, for example, a motorcycle, and includes a vehicle body 2, a front wheel 3, and a rear wheel 4. The vehicle 1 turns in a leaning posture. Specifically, the vehicle 1 leans leftward when turning to the left and leans rightward when turning to the right.

The vehicle body 2 supports components such as a vehicle body cover 5, a bar handle 6, a seat 7, a fuel tank 8, and a power unit 9. In this embodiment, the vehicle body 2 includes a frame 10 and supports components of the vehicle 1.

The frame 10 includes a head pipe 11, a main frame 12, a seat rail 13, and a rear arm 14.

The head pipe 11 is located in a front portion of the vehicle 1 and rotatably supports an unillustrated steering shaft connected to the bar handle 6 for steering the front wheel 3. A meter 15 is fixed to an upper portion of the head pipe 11. A headlight 16 is fixed to a portion of the head pipe 11 below the meter 15.

The meter 15 is an appearance component that can be at least partially visually recognized at least when seen in the top-bottom direction that is a viewing direction. The headlight 16 is an appearance component that can be at least partially visually recognized at least when seen in the front-rear direction that is a viewing direction.

A front portion of the main frame 12 is connected to the head pipe 11 and extends rearward in the vehicle. A rear portion of the main frame 12 extends rearward and downward in the vehicle. The main frame 12 supports, for example, the power unit 9 including an engine 9*a* for driving the front wheel 3 or the rear wheel 4. The engine 9*a* is coupled to an intake pipe 9*b* that is an intake passage through which sucked outside air passes.

A fuel tank 8 is fixed to an upper portion of the main frame 12. In the left-right direction of the vehicle 1, the vehicle body cover 5 is partially fixed to at least a part of the surface of the main frame 12. That is, a part of the main frame 12 located under the fuel tank 8 is covered with a part of the vehicle body cover 5. In this embodiment, a lower end portion and a rear end portion of the main frame 12 are not covered with the vehicle body cover 5 and other members, and are exposed. That is, at least a part of the main frame 12 constitutes an outer surface of the vehicle 1 in the left-right direction.

The main frame 12 is an appearance component that can be at least partially visually recognized at least when seen in the left-right direction that is a viewing direction. The fuel tank 8 is an appearance component that can be at least partially visually recognized at least when seen in the top-bottom direction or the left-right direction that is a viewing direction. The fuel tank 8 as the appearance component may include a tank cover covering the fuel tank 8 and/or a dummy tank.

As illustrated in FIG. 1, the seat rail 13 is connected to a portion above the rear end of the main frame 12. That is, the seat rail 13 extends from the rear end portion of the main frame 12 toward the rear of the vehicle 1. A seat 7 on which a passenger is seated is disposed at the center of the vehicle 1 in the left-right direction above the seat rail 13. The seat 7 covers at least a part of an upper outer surface of the vehicle 1. The vehicle body cover 5 is partially fixed to at least a part of the surface of the seat rail 13. That is, at least a part of the seat rail 13 is covered with the vehicle body cover 5. A taillight 17 is fixed to the rear end of the seat rail 13. The taillight 17 covers at least a part of the rear wheel 4 when seen from above.

The seat 7 is an appearance component that can be at least partially visually recognized at least when seen in the top-bottom direction or the left-right direction that is a viewing direction. The taillight 17 is an appearance component that can be at least partially visually recognized at least when seen in the front-rear direction that is a viewing direction.

The rear arm 14 is connected to a lower portion of a rear end portion of the main frame 12. The rear arm 14 extends rearward of the vehicle 1 from the rear end portion of the main frame 12. A front end portion of the rear arm 14 is swingably supported by the rear end portion of the main frame 12. A rear end portion of the rear arm 14 rotatably supports the rear wheel 4. The rear arm 14 is an appearance component that can be at least partially visually recognized at least when seen in the left-right direction that is a viewing direction.

The vehicle body cover 5 includes a front cover 21, a side cover 22, and a rear cover 23. The front cover 21 and the side cover 22 are fixed to the main frame 12.

The front cover 21 is disposed in a front portion of the vehicle 1 and below the bar handle 6 and the fuel tank 8. The front cover 21 covers at least a part of the front side of the vehicle 1 and the left and right outer surfaces of the vehicle 1. Accordingly, the front cover 21 covers at least a part of the fuel tank 8, at least a part of the power unit 9, at least a part of the frame 10, and at least a part of the meter 15 and the headlight 16 fixed to the head pipe 11.

The side cover 22 is disposed above and rearward of the front cover 21. The side cover 22 is disposed below and rearward of the fuel tank 8. The side cover 22 covers at least a part of the left and right outer surfaces of the vehicle 1 located rearward of the front cover 21. At least a part of the main frame 12 is covered with the front cover 21 and the side cover 22.

The rear cover 23 is fixed to the seat rail 13. A front portion of the rear cover 23 is disposed below and rearward of the seat 7. The rear cover 23 extends obliquely more upward toward the rear of the vehicle 1. The rear cover 23 covers the seat rail 13 from the left and right of the vehicle 1 and from above the vehicle 1.

The front cover 21 is an appearance component that can be at least partially visually recognized at least when seen in the front-rear direction or the left-right direction that is a viewing direction. The side cover 22 is an appearance component that can be at least partially visually recognized at least when seen in the left-right direction that is a viewing direction. The rear cover 23 is an appearance component that can be at least partially visually recognized at least when seen in the front-rear direction or the left-right direction that is a viewing direction.

<Overall Configuration of Evaporative Emission System 30>

Figure 3:
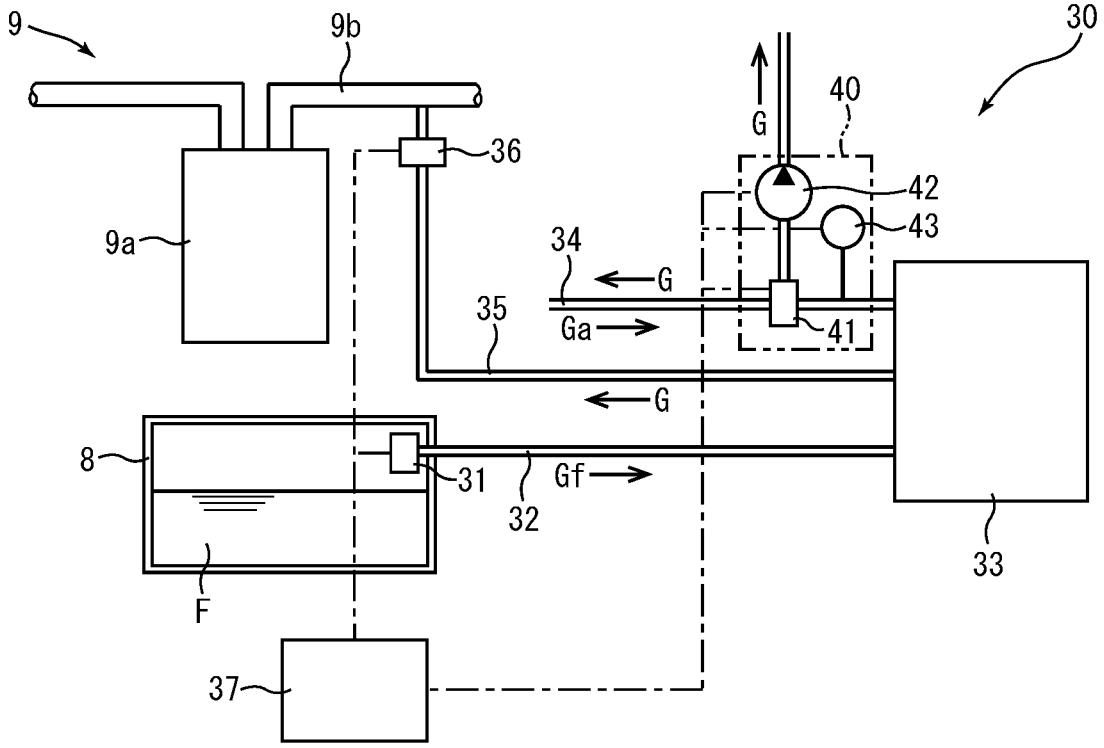
FIG. 3 is a schematic configuration view of an evaporative emission system according to a first embodiment mounted on the straddled vehicle according to the present teaching.

Then, an evaporative emission system 30 according to the first embodiment of an evaporative emission system mounted on the vehicle 1 according to the present teaching will be described with reference to FIG. 3. FIG. 3 is a schematic configuration view of the evaporative emission system 30 according to the first embodiment mounted on the vehicle 1 according to the embodiment of the present teaching.

As illustrated in FIG. 3, the evaporative emission system 30 is a system that suppresses emission, into the air, of evaporation fuel Gf obtained by vaporization of fuel F in the fuel tank 8. The evaporative emission system 30 includes a shut-off valve 31, a first purge pipe 32, a canister 33, a vent pipe 34, a second purge pipe 35, a purge control valve 36, and a control device 37. The evaporative emission system 30 also includes a gas-leak-detection device 40.

In the evaporative emission system 30, the shut-off valve 31 is a switching valve that switches a gas passage in which a gas G including at least one of evaporation fuel Gf or outside air Ga flows between a closed state in which the gas passage is closed and an open state in which the gas passage is open. The shut-off valve 31 is, for example, an electromagnetic solenoid valve. The shut-off valve 31 is coupled to the fuel tank 8 that stores fuel F to be supplied to the engine 9*a*. In this embodiment, the shut-off valve 31 is located in the fuel tank 8. One end of the first purge pipe 32 is connected to the shut-off valve 31 from outside of the fuel tank 8.

The shut-off valve 31 switches between a closed state of closing one end of the first purge pipe 32 and an open state of opening one end of the first purge pipe 32. While the shut-off valve 31 is in the closed state, the evaporation fuel Gf in the fuel tank 8 does not flow into the first purge pipe 32. While the shut-off valve 31 is in the open state, the evaporation fuel Gf in the fuel tank 8 flows into the first purge pipe 32 through the inside of the shut-off valve 31. In the manner described above, the shut-off valve 31 in which the evaporation fuel Gf flows constitutes a part of the gas passage. The shut-off valve 31 may be located outside the fuel tank 8. The shut-off valve 31 may be supported by a component other than the fuel tank 8.

The first purge pipe 32 is a pipe through which the evaporation fuel Gf in the fuel tank 8 flows to the canister 33. The other end of the first purge pipe 32 is connected to the canister 33. That is, the first purge pipe 32 connects the shut-off valve 31 and the canister 33. The first purge pipe 32 is switched by the shut-off valve 31 between an open state in which the evaporation fuel Gf in the fuel tank 8 flows and a shut-off state in which the evaporation fuel Gf in the fuel tank 8 does not flow. The first purge pipe 32 in which the evaporation fuel Gf flows constitutes a part of the gas passage.

The canister 33 is a fuel-evaporation-gas-absorbing device that collects the evaporation fuel Gf and discharges the collected evaporation fuel Gf to an intake pipe 9*b* of the engine 9*a* together with outside air Ga. The canister 33 includes a casing and unillustrated activated carbon serving as an adsorbent that adsorbs the evaporation fuel Gf. Activated carbon is disposed in an internal space of the casing The other end of the first purge pipe 32 is connected to the canister 33. Accordingly, the evaporation fuel Gf in the fuel tank 8 flows into the canister 33 from the first purge pipe 32. The vent pipe 34 and the second purge pipe 35 are connected to the canister 33. The outside air Ga flows into the canister 33 from the vent pipe 34. In this manner, the internal space of the canister 33 in which the evaporation fuel Gf and the outside air Ga flow constitute a part of the gas passage.

The vent pipe 34 that is an outside-air-introduction passage is a pipe through which the gas G in the canister 33 is discharged into the air and outside air Ga is introduced into the canister 33. One end of the vent pipe 34 is connected to the canister 33. The other end of the vent pipe 34 is open to the air. Accordingly, the vent pipe 34 enables the outside air Ga to be introduced into the canister 33 from the other end thereof. The vent pipe 34 enables the gas G after absorption of the evaporation fuel Gf by activated carbon in the canister 33 to be discharged to the air. The vent pipe 34 in which the gas G after absorption of the evaporation fuel Gf flows constitutes a part of the gas passage.

The second purge pipe 35 is a pipe through which the gas G including the evaporation fuel Gf and the outside air Ga in the canister 33 flows to the intake pipe 9*b* of the engine 9*a*. One end of the second purge pipe 35 is connected to the canister 33. The other end of the second purge pipe 35 is connected to the intake pipe 9*b* of the engine 9*a*. Accordingly, the second purge pipe 35 can discharge the gas G in the canister 33 to the intake pipe 9*b*. The second purge pipe 35 in which the gas G flows constitutes a part of the gas passage. The purge control valve 36 is disposed in the second purge pipe 35.

The purge control valve 36 is a flow-rate-control valve capable of continuously changing an opening degree between a closed state in which the second purge pipe 35 is closed and an open state in which the second purge pipe 35 is open. The purge control valve 36 is, for example, an electromagnetic-proportional-control valve. The purge control valve 36 is disposed at an arbitrary position in the second purge pipe 35. The purge control valve 36 is coupled to a component constituting the vehicle 1. The purge control valve 36 is coupled to, for example, the frame 10.

While the purge control valve 36 is in the closed state, a gas G in the canister 33 is not discharged from the second purge pipe 35 to the intake pipe 9*b*. While the purge control valve 36 is not in the closed state, the gas G in the canister 33 passes through the purge control valve 36 at a flow rate proportional to the opening degree of the purge control valve 36 and is discharged from the second purge pipe 35 to the intake pipe 9*b*. In the manner described above, the purge control valve 36 in which the gas G flows constitutes a part of the gas passage.

The control device 37 controls the evaporative emission system 30. The control device 37 is, for example, an ECU for controlling driving of the engine 9*a*. The control device 37 is electrically connected to the shut-off valve 31 and the purge control valve 36. The control device 37 stores various programs and data for controlling the shut-off valve 31, the purge control valve 36, and the gas-leak-detection device 40. The control device 37 controls the shut-off valve 31 such that the shut-off valve 31 switches between the closed state and the open state. The control device 37 performs control such that the opening degree of the purge control valve 36 continuously changes from the closed state to the open state. The control device 37 may be a member separated from the ECU.

<Purge Operation of Evaporative Emission System>

In the thus-configured evaporative emission system 30, while the engine 9*a* is not operated, the control device 37 switches the shut-off valve 31 to the open state. In addition, the control device 37 switches the purge control valve 36 to the closed state. The evaporation fuel Gf generated in the fuel tank 8 flows into the canister 33 through the first purge pipe 32. The evaporation fuel Gf that has flowed into the canister 33 is adsorbed by activated carbon. The gas G after adsorption of the evaporation fuel Gf is discharged to the air from the vent pipe 34.

While the engine is operated, the control device 37 switches the shut-off valve 31 to the closed state. In addition, the control device 37 controls the opening degree of the purge control valve 36 depending on an operating state of the engine 9*a*. The gas G in the gas passage of the evaporative emission system 30 is caused to flow toward the intake pipe 9*b* by a pressure decrease in the intake pipe 9*b* due to operation of the engine 9*a*. Accordingly, the pressure in the gas passage becomes negative.

The evaporative emission system 30 introduces the outside air Ga into the canister 33 from the vent pipe 34 by using a negative pressure in the gas passage. The outside air Ga that has flowed into the canister 33 is mixed with the evaporation gas Gf adsorbed on activated carbon. The evaporative emission system 30 discharges a gas G as a mixture of the outside air Ga and the evaporation fuel Gf to the intake pipe 9*b* from the second purge pipe 35. In the evaporative emission system 30, since the evaporation fuel Gf adsorbed on activated carbon is removed by the outside air Ga, the capacity of the evaporation fuel Gf that can be collected by activated carbon increases.

<Configuration of Leak Detection Device>

Figure 4:
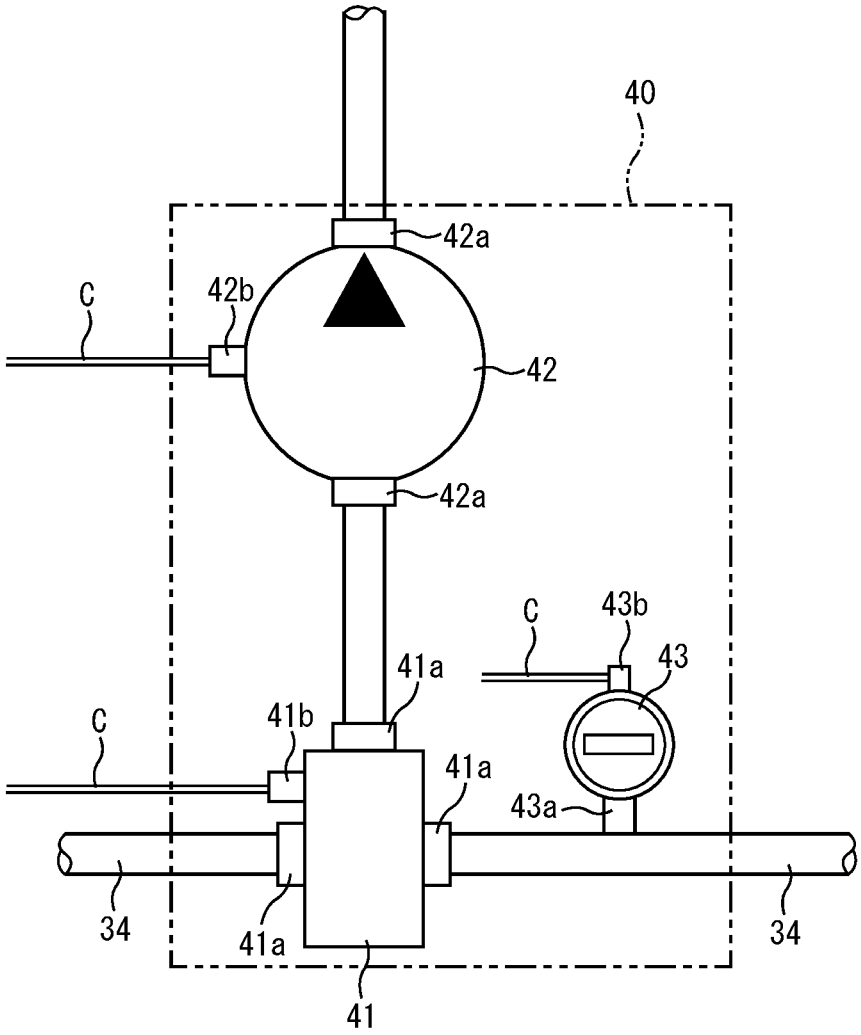
FIG. 4 is a configuration view of passage connection portions and electric-wire-connection portions of a vent valve, a suction pump, and a pressure sensor in the evaporative emission system according to the first embodiment.

Next, with reference to FIGS. 3 and 4, the gas-leak-detection device 40 of the evaporative emission system 30 will be described. FIG. 4 is a configuration view of passage connection portions and electric-wire-connection portions of the vent valve 41, the suction pump 42, and the pressure sensor 43 in the evaporative emission system 30.

As illustrated in FIG. 3, the gas-leak-detection device 40 detects leakage of a gas G from the evaporative emission system 30. The gas-leak-detection device 40 is a leak detection device of a forced-negative-pressure type that detects leakage of a gas from the gas passage with the pressure in the gas passage of the evaporative emission system 30 being forcibly made negative.

The gas-leak-detection device 40 includes a vent valve 41, a suction pump 42, and a pressure sensor 43 that are components for a leak test of a gas G from the evaporative emission system 30. Each of the vent valve 41, the suction pump 42, and the pressure sensor 43 includes separate casings that are independent of one another.

The vent valve 41 is an electric valve that switches between a closed state of closing the vent pipe 34 as an outside-air-introduction passage and an open state of opening the vent pipe 34. The vent valve 41 is, for example, an electromagnetic solenoid valve. The vent valve 41 is disposed at an arbitrary position in the vent pipe 34. A suction pump 42 is connected to the vent valve 41. The vent valve 41 switches to a state in which the suction pump 42 can suck the gas G in the air passage, in the closed state of closing the vent pipe 34. In addition, the vent valve 41 switches to a state in which the suction pump 42 cannot suck the gas G in the gas passage, in the open state of opening the vent pipe 34. In the manner described above, the vent valve 41 in which the gas G flows constitutes a part of the gas passage.

A vent pipe 34 constituting a part of the gas passage is connected to the vent valve 41. The vent valve 41 includes a vent-valve-passage-connection portion 41*a* that is a passage connection portion to which the vent pipe 34 is connected. The vent pipe 34 is connected to the vent-valve-passage-connection portion 41*a*.

As illustrated in FIG. 4, an electric wire C for supplying electric power stored in an unillustrated battery of the vehicle 1 is connected to the vent valve 41. The vent valve 41 includes a vent-valve-electric-wire-connection portion 41*b* that is an electric-wire-connection portion to which the electric wire C is connected. The electric wire C is connected to the vent-valve-electric-wire-connection portion 41*b*.

While the vent valve 41 is in the open state, the evaporative emission system 30 discharges, to the air, the gas G not including the evaporation fuel Gf in the canister 33 from the vent pipe 34. On the other hand, while the vent valve 41 is in the open state, the evaporative emission system 30 introduces the outside air Ga from the vent pipe 34 to the canister 33. In this case, the suction pump 42 cannot suck the gas G in the gas passage.

While the vent valve 41 is in the closed state, the evaporative emission system 30 does not discharge the gas G in the canister 33 from the vent pipe 34 to the air. While the vent valve 41 is in the closed state, the evaporative emission system 30 does not introduce outside air Ga from the vent pipe 34 into the canister 33. In this case, the suction pump 42 is capable of sucking the gas G in the gas passage. The vent valve 41 is electrically connected to the control device 37. Accordingly, the control device 37 can control the vent valve 41.

The suction pump 42 is an electric suction pump 42 that sucks the gas G in the gas passage. The suction pump 42 is, for example, a rotary pump. The suction pump 42 is disposed in, for example, the vent valve 41.

The vent valve 41 constituting a part of the gas passage is connected to the suction pump 42. That is, the suction pump 42 is connected to the gas passage in the vent valve 41. The suction pump 42 includes a suction-pump-passage-connection portion 42*a* that is a passage connection portion to which the vent valve 41 is connected. The vent valve 41 is connected to the suction-pump-passage-connection portion 42*a*.

An electric wire C for supplying electric power stored in an unillustrated of the vehicle 1 is connected to the suction pump 42. The suction pump 42 includes a suction-pump-electric-wire-connection portion 42*b* that is an electric-wire-connection portion to which the electric wire C is connected. The electric wire C is connected to the suction-pump-electric-wire-connection portion 42*b*.

The suction pump 42 can suck the gas G in the gas passage while the vent valve 41 is in the closed state. That is, the suction pump 42 changes the pressure in the gas passage to negative. The suction pump 42 is electrically connected to the control device 37. Accordingly, the control device 37 can control the suction pump 42.

The pressure sensor 43 is a sensor for measuring a pressure in the gas passage. The pressure sensor 43 is disposed at one of an arbitrary location in the first purge pipe 32, a location closer to the canister 33 than the vent valve 41 in the vent pipe 34, a location in the canister 33, or a location closer to the canister 33 than the purge control valve 36 in the second purge pipe 35. The pressure sensor 43 measures a pressure in the gas passage. The pressure sensor 43 is electrically connected to the control device 37. Accordingly, the control device 37 can acquire measurement data from the pressure sensor 43.

The pressure sensor 43 is connected to one of the first purge pipe 32, the vent pipe 34, the canister 33, or the second purge pipe 35. The pressure sensor 43 includes a pressure-sensor-passage-connection portion 43*a* that is a passage connection portion connected to the gas passage including the first purge pipe 32, the vent pipe 34, the canister 33, or the second purge pipe 35. The pressure-sensor-passage-connection portion 43*a* is connected to the gas passage.

An electric wire C for supplying electric power stored in an unillustrated battery of the vehicle 1 is connected to the pressure sensor 43. The pressure sensor 43 includes a pressure-sensor-electric-wire-connection portion 43*b* that is an electric-wire-connection portion to which the electric wire C is connected. The electric wire C is connected to the pressure-sensor-electric-wire-connection portion 43*b*.

<Leak Detection of Evaporative Emission System>

As illustrated in FIG. 3, to detect leakage of a gas G from the evaporative emission system 30, the control device 37 switches the shut-off valve 31, the purge control valve 36, and the vent valve 41 to the closed state. Accordingly, in the evaporative emission system 30, the gas passage is hermetically sealed. Then, the control device 37 sucks the gas G in the gas passage by the suction pump 42. The control device 37 measures a pressure in the gas passage by the pressure sensor 43. If the measured value of the pressure sensor 43 is a reference value or more, the control device 37 determines that there is a possibility of leakage of the gas from the gas passage of the evaporative emission system 30.

Figure 5A:
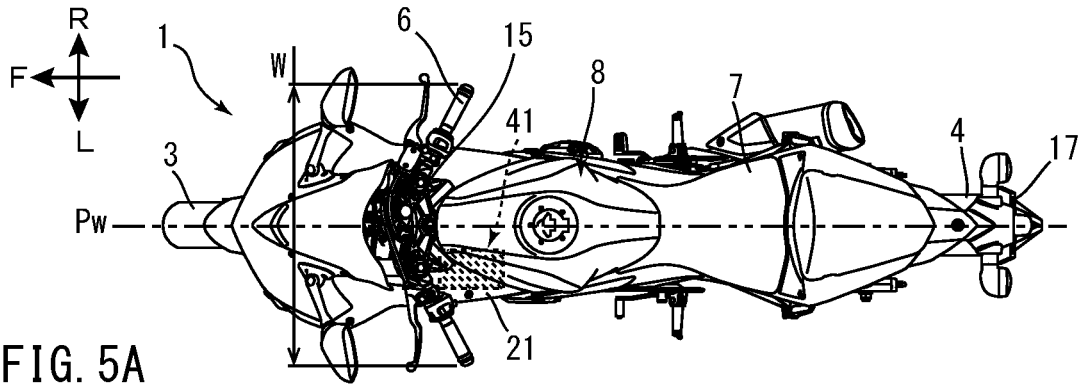
FIG. 5A is a plan view of the straddled vehicle illustrating an example of a state where the passage connection portion and the electric-wire-connection portion of the vent valve in the evaporative emission system according to the first embodiment are disposed closer to an appearance component than an imaginary-lateral-center plane of the straddled vehicle.
Figure 5B:
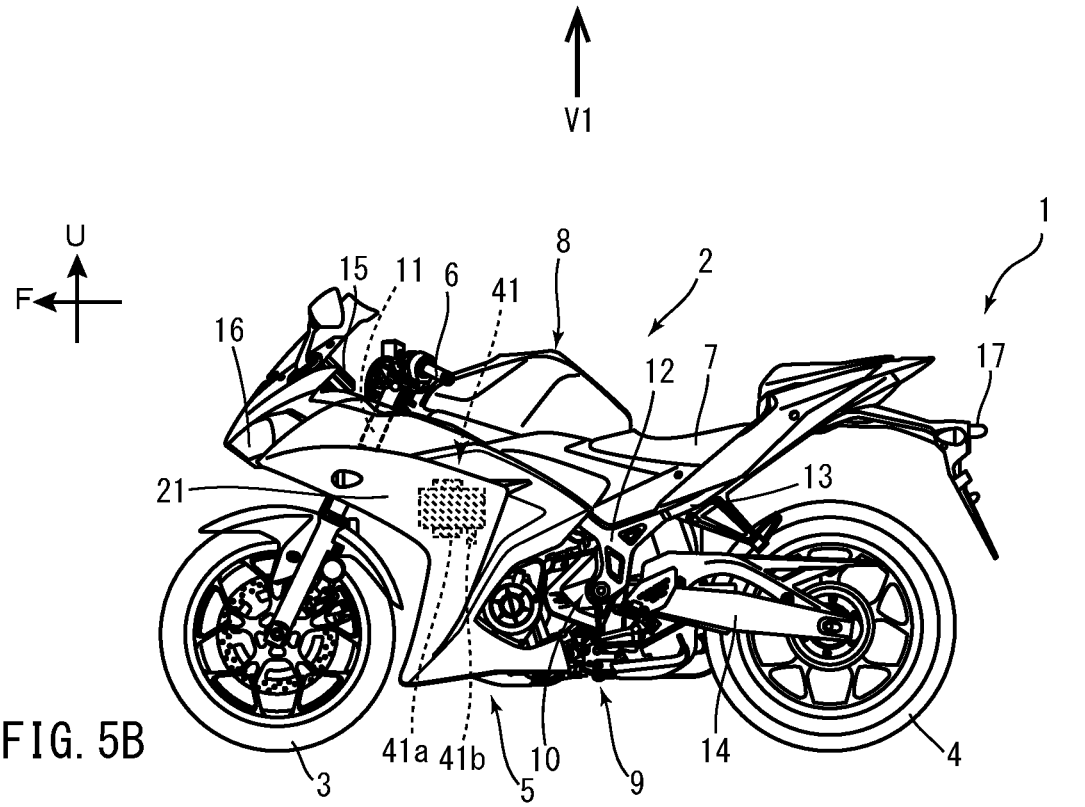
FIG. 5B is a side view of the straddled vehicle illustrating an example of the state where the passage connection portion and the electric-wire-connection portion of the vent valve in the evaporative emission system according to the first embodiment are disposed closer to the appearance component than the imaginary-lateral-center plane of the straddled vehicle.
Figure 6A:
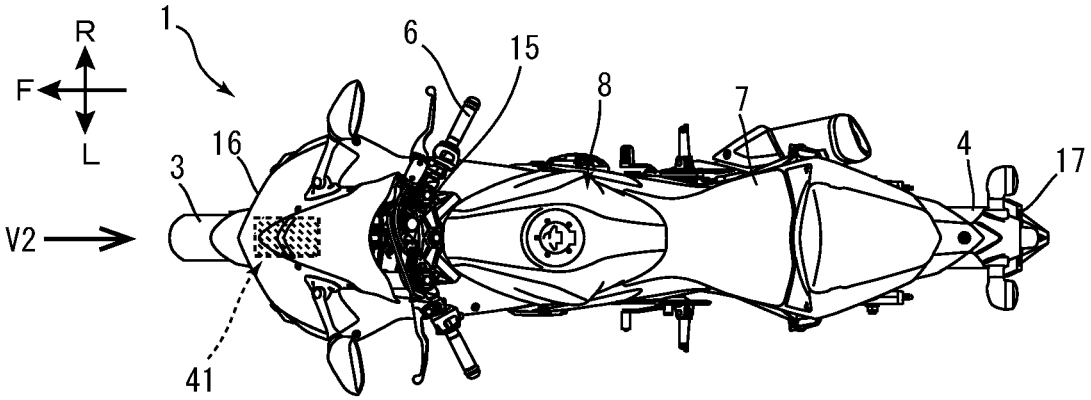
FIG. 6A is a plan view of the straddled vehicle illustrating an example of a state where the passage connection portion and the electric-wire-connection portion of the vent valve in the evaporative emission system according to the first embodiment are disposed closer to an appearance component than an imaginary-longitudinal-center plane of the straddled vehicle.
Figure 6B:
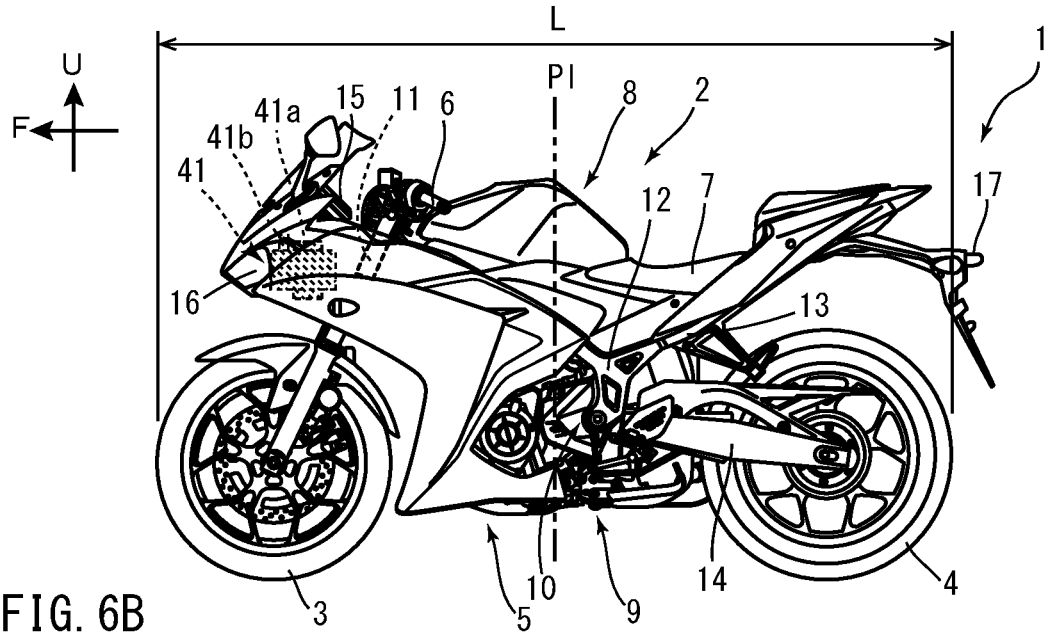
FIG. 6B is a side view of the straddled vehicle illustrating an example of the state where the passage connection portion and the electric-wire-connection portion of the vent valve in the evaporative emission system according to the first embodiment are disposed closer to the appearance component than the imaginary-longitudinal-center plane of the straddled vehicle.
Figure 7A:
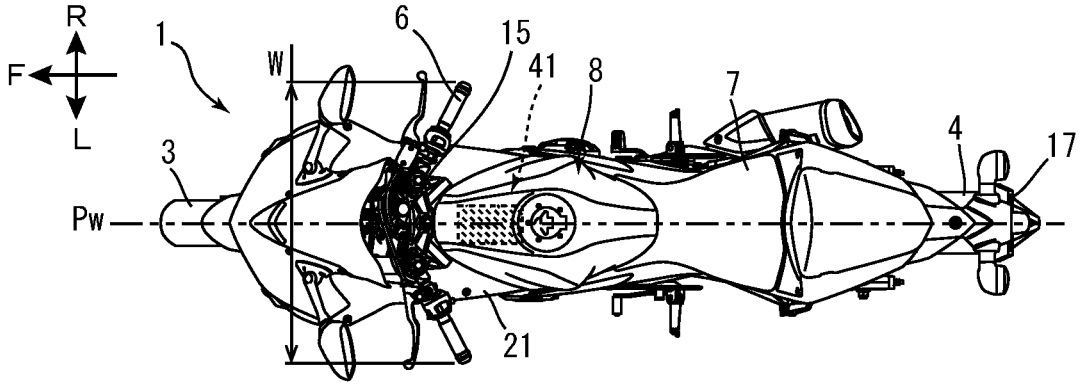
FIG. 7A is a plan view of the straddled vehicle illustrating an example of a state where the passage connection portion and the electric-wire-connection portion of the vent valve in the evaporative emission system according to the first embodiment are disposed closer to an appearance component than an imaginary-vertical-center plane of the straddled vehicle.
Figure 7B:
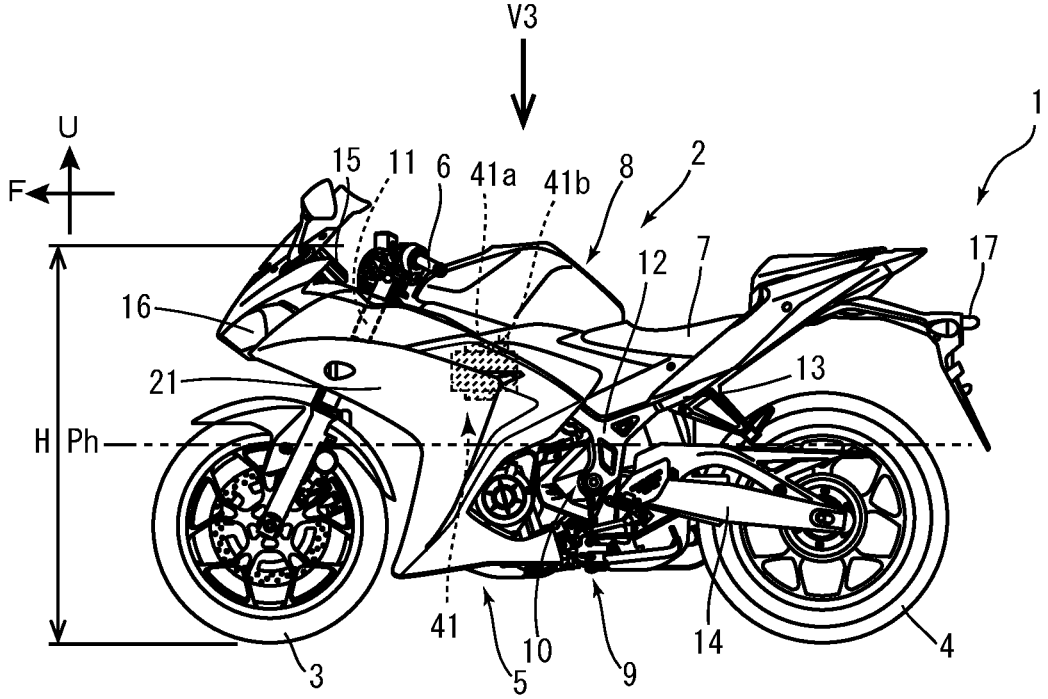
FIG. 7B is a side view of the straddled vehicle illustrating an example of the state where the passage connection portion and the electric-wire-connection portion of the vent valve in the evaporative emission system according to the first embodiment are disposed closer to an appearance component than the imaginary-vertical-center plane of the straddled vehicle.
Figure 8A:
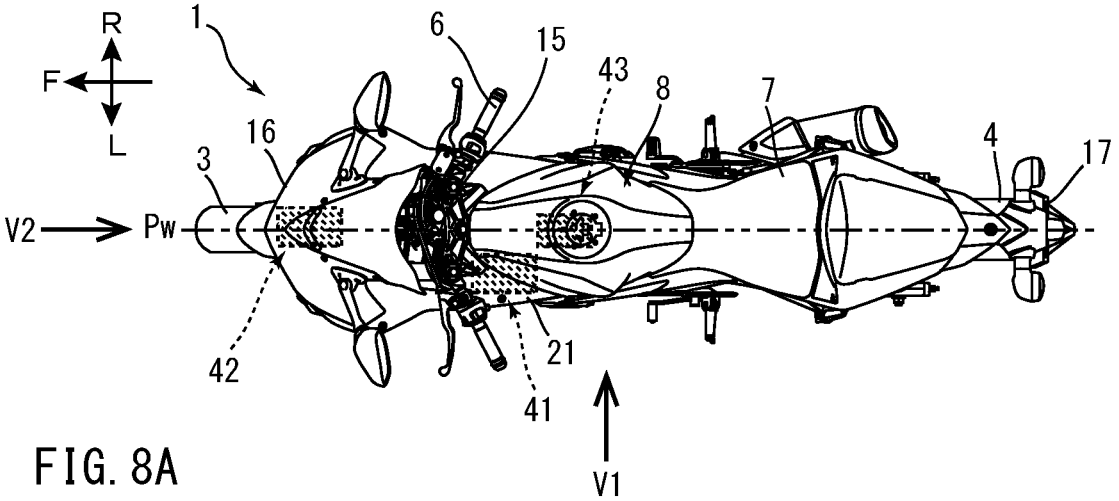
FIG. 8A is a plan view of the straddled vehicle illustrating an example of a state where the passage connection portions and the electric-wire-connection portions of the vent valve, the suction pump, and the pressure sensor in the evaporative emission system according to the first embodiment are disposed at positions overlapping with different appearance components.
Figure 8B:
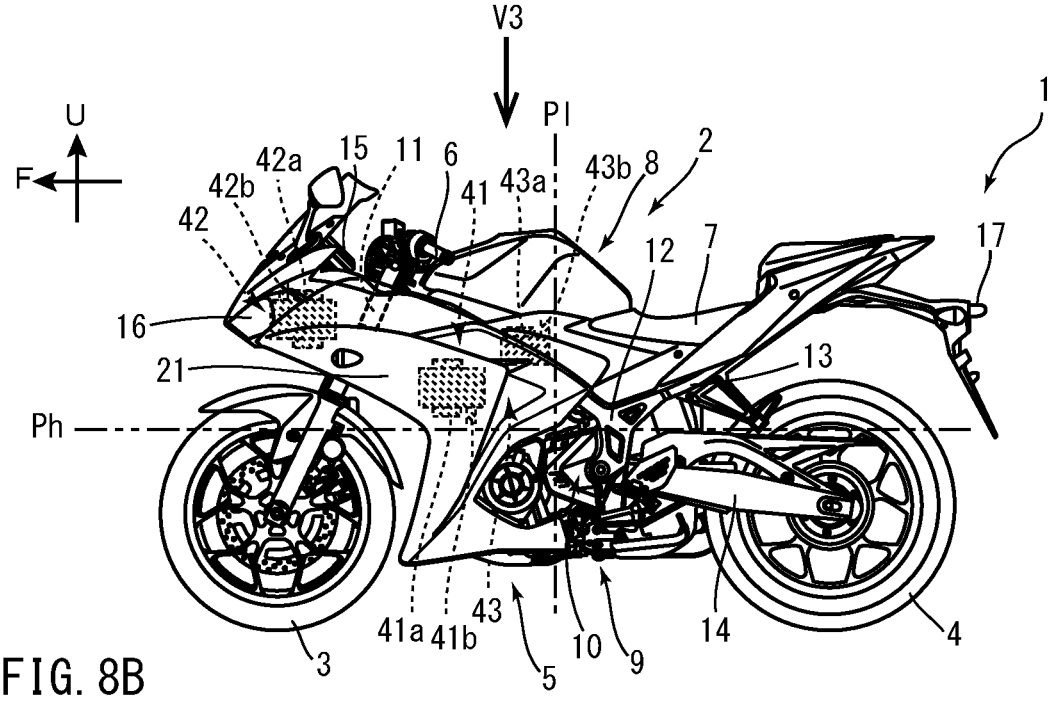
FIG. 8B is a side view of the straddled vehicle illustrating an example of the state where the passage connection portions and the electric-wire-connection portions of the vent valve, the suction pump, and the pressure sensor in the evaporative emission system according to the first embodiment are disposed at positions overlapping with different appearance components.
Figure 15:
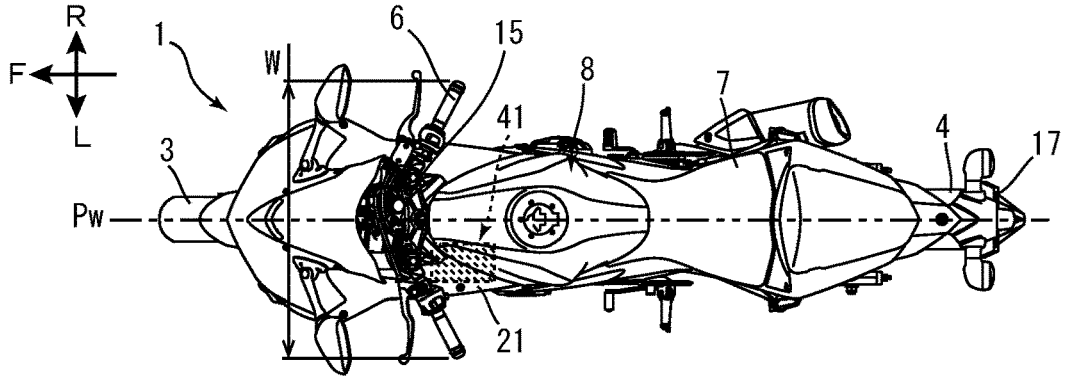
FIG. 15 shows a plan view illustrating an example of a state where a gas-leak-detection device is disposed closer to an appearance component than the imaginary-lateral-center plane of the straddled vehicle in the evaporative emission system according to the present teaching, and side views of the straddled vehicle illustrating an example of a state where the gas-leak-detection device is disposed closer to the appearance component than the imaginary-longitudinal-center plane and an example of a state where the gas-leak-detection device is disposed closer to the appearance component than the imaginary-vertical-center plane.
Figure 15:
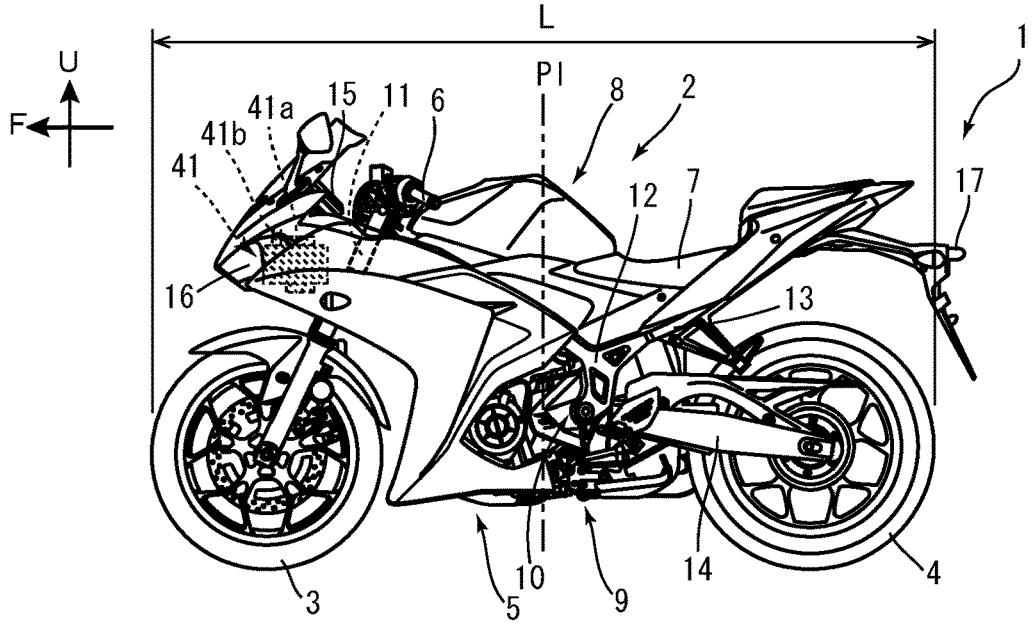
Figure 15:
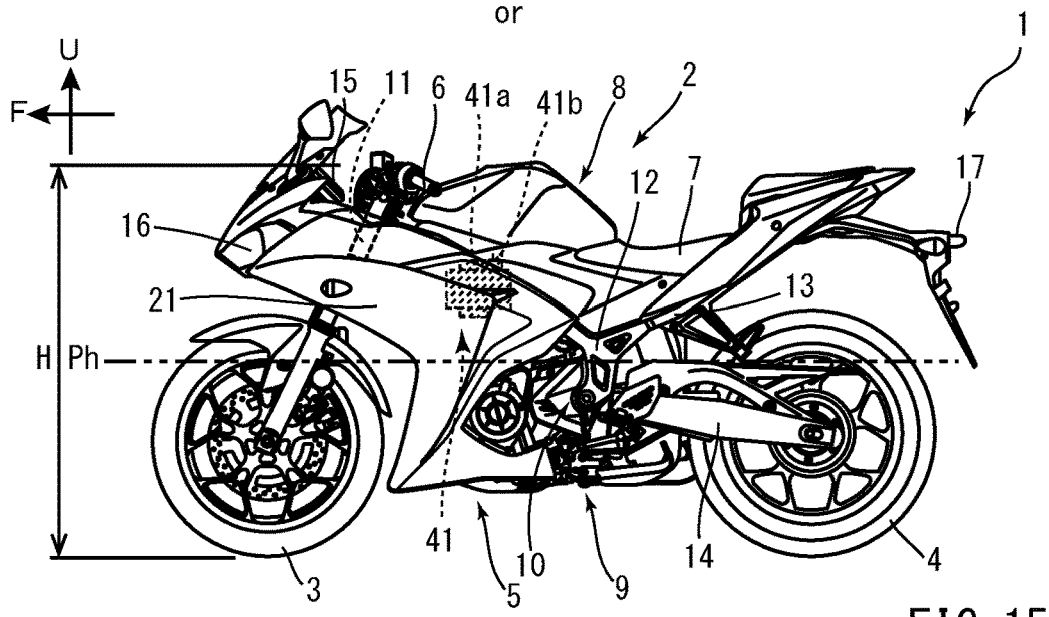

Then, with reference to FIGS. 5 through 8 and 15, arrangement of the vent valve 41, the suction pump 42, and the pressure sensor 43 of the gas-leak-detection device 40 in the vehicle 1 will be described. FIG. 5A is a plan view of the vehicle 1 illustrating a state where the vent-valve-passage-connection portion 41*a* and the vent-valve-electric-wire-connection portion 41*b* are disposed closer to an appearance component than an imaginary-lateral-center plane Pw of the vehicle 1. FIG. 5B is a side view illustrating this state. FIG. 6A a plan view of the vehicle 1 illustrating a state where the vent-valve-passage-connection portion 41*a* and the vent-valve-electric-wire-connection portion 41*b* are disposed closer to an appearance component than an imaginary-longitudinal-center plane Pl of the vehicle 1. FIG. 6B is a side view illustrating this state. FIG. 7A is a plan view of the vehicle 1 illustrating a state where the vent-valve-passage-connection portion 41*a* and the vent-valve-electric-wire-connection portion 41*b* are disposed closer to an appearance component than an imaginary-vertical-center plane Ph of the vehicle 1. FIG. 7B is a side view illustrating this state. FIG. 8A is a plan view of the vehicle 1 illustrating a state where the passage connection portions and the electric-wire-connection portions of the vent valve 41, the suction pump 42, and the pressure sensor 43 are disposed at positions overlapping with different appearance components. FIG. 8B is a side view of illustrating this state. FIG. 15 shows a plan view illustrating an example of a state where the gas-leak-detection device 40 is disposed closer to an appearance component than the imaginary-lateral-center plane Pw of the vehicle 1 in the evaporative emission system 30 according to the present teaching, and side views of the vehicle 1 illustrating an example of a state where the gas-leak-detection device 40 is disposed closer to the appearance component than the imaginary-longitudinal-center plane Pl and an example of a state where the gas-leak-detection device 40 is disposed closer to the appearance component than the imaginary-vertical-center plane Ph.

<A Case where Three Components Overlap with Same Appearance Component>

As illustrated in FIGS. 5 through 8 and 15, in the vehicle 1, the vent valve 41, the suction pump 42, and the pressure sensor 43 are disposed at locations at which the passage connection portion and the electric-wire-connection portion of each of the vent valve 41, the suction pump 42, and the pressure sensor 43 overlap with at least one appearance component when seen the vehicle 1 is seen in one viewing direction that is one of the top-bottom direction, the front-rear direction, or the left-right direction.

In addition, in the vehicle 1, the passage connection portion and the electric-wire-connection portion are disposed closer to the appearance component overlapping with the electric-wire-connection portion and the passage connection portion than a center surface perpendicular to a viewing direction in which the electric-wire-connection portion and the passage connection portion overlap with the appearance component in the vehicle 1 in an upright state, and the center plane is one of the imaginary-lateral-center plane Pw that is an imaginary vertical plane including a center of the bar handle 6 in the left-right direction and being perpendicular to the left-right direction, the imaginary-longitudinal-center plane Pl that is an imaginary vertical plane including a center in the front-rear direction between the front end of the front wheel 3 and the rear end of the rear wheel 4 and being perpendicular to the front-rear direction, or the imaginary-vertical-center plane Ph that is an imaginary horizontal plane including a center in the top-bottom direction between the upper end of the bar handle 6 and the lower end of the front wheel 3 and being perpendicular to the top-bottom direction.

The following description is directed to arrangement of the vent valve 41, and description of the suction pump 42 and the pressure sensor 43 will be omitted. The suction pump 42 and the pressure sensor 43 are disposed to overlap with an appearance component overlapping with the vent valve 41, in a viewing direction in which the vent valve 41 overlaps with the appearance component.

As illustrated in FIG. 5, in the vehicle 1, the vent valve 41 is disposed such that the front cover 21 as an appearance component overlaps with the vent-valve-passage-connection portion 41*a* and the vent-valve-electric-wire-connection portion 41*b* when the vehicle 1 is seen in the left-right direction that is a viewing direction V1. In this case, the vent-valve-passage-connection portion 41*a* and the vent-valve-electric-wire-connection portion 41*b* are disposed closer to the front cover 21 overlapping with the vent-valve-passage-connection portion 41*a* and the vent-valve-electric-wire-connection portion 41*b* in the viewing direction V1 than the imaginary-lateral-center plane Pw.

As illustrated in FIG. 6, in the vehicle 1, the vent valve 41 is disposed such that the headlight 16 as an appearance component overlaps with the vent-valve-passage-connection portion 41*a* and the vent-valve-electric-wire-connection portion 41*b* when the vehicle 1 is seen in the front-rear direction that is a viewing direction V2. In this case, the vent-valve-passage-connection portion 41*a* and the vent-valve-electric-wire-connection portion 41*b* are disposed closer to the headlight 16 overlapping with the vent-valve-passage-connection portion 41*a* and the vent-valve-electric-wire-connection portion 41*b* in the viewing direction V2 than the imaginary-longitudinal-center plane Pl.

As illustrated in FIG. 7, in the vehicle 1, the vent valve 41 is disposed such that the fuel tank 8 as an appearance component overlaps with the vent-valve-passage-connection portion 41*a* and the vent-valve-electric-wire-connection portion 41*b* when the vehicle is seen in the top-bottom direction that is a viewing direction V3. In this case, the vent-valve-passage-connection portion 41*a* and the vent-valve-electric-wire-connection portion 41*b* are disposed closer to the fuel tank 8 overlapping with the vent-valve-passage-connection portion 41*a* and the vent-valve-electric-wire-connection portion 41*b* in the viewing direction V3 than the imaginary-vertical-center plane Ph.

<A Case where Three Components Overlap with Different Appearance Components>

In the vehicle 1, the vent valve 41, the suction pump 42, and the pressure sensor 43 may be disposed such that the passage connection portions and the electric-wire-connection portions thereof overlap with different appearance components when the vehicle 1 is seen in different viewing directions.

As illustrated in FIG. 8, for example, in the vehicle 1, the vent valve 41 is disposed such that the front cover 21 as an appearance component overlaps with the vent-valve-passage-connection portion 41*a* and the vent-valve-electric-wire-connection portion 41*b* when the vehicle 1 is seen in the left-right direction that is the viewing direction V1. In this case, the vent-valve-passage-connection portion 41*a* and the vent-valve-electric-wire-connection portion 41*b* are disposed closer to the front cover 21 than the imaginary-lateral-center plane Pw. In the vehicle 1, the suction pump 42 is disposed such that the headlight 16 as an appearance component overlaps with the suction-pump-passage-connection portion 42*a* and the suction-pump-electric-wire-connection portion 42*b* when the vehicle 1 is seen in the front-rear direction that is the viewing direction V2. In this case, the suction-pump-passage-connection portion 42*a* and the suction-pump-electric-wire-connection portion 42*b* are disposed closer to the suction pump 42 than the imaginary-longitudinal-center plane Pl. In the vehicle 1, the pressure sensor 43 is disposed such that the fuel tank 8 overlaps with the pressure-sensor-passage-connection portion 43*a* and the pressure-sensor-electric-wire-connection portion 43*b* when the vehicle 1 is seen in the top-bottom direction that is the viewing direction V3. In this case, the pressure-sensor-passage-connection portion 43*a* and the pressure-sensor-electric-wire-connection portion 43*b* are disposed closer to the fuel tank 8 than the imaginary-vertical-center plane Ph.

<A Case where Two Components Overlap with Same Appearance Component>

At least one of the vent valve 41, the suction pump 42, or the pressure sensor 43 may be disposed such that the passage connection portions and the electric-wire-connection portions thereof overlap with an appearance component different from an appearance component overlapping with the passage connection portion and the electric-wire-connection portion of another component, when the vehicle 1 is seen in a viewing direction different from other components.

As illustrated in FIG. 8, when the vehicle 1 is seen in the left-right direction that is the viewing direction V1, the vent valve 41 is disposed such that the vent-valve-passage-connection portion 41*a* and the vent-valve-electric-wire-connection portion 41*b* overlap with the front cover 21 as an appearance component, and the suction pump 42 is disposed such that the suction-pump-passage-connection portion 42*a* and the suction-pump-electric-wire-connection portion 42*b* overlap with the front cover 21 as an appearance component. On the other hand, the pressure sensor 43 is disposed such that the vent-valve-passage-connection portion 41*a* and the vent-valve-electric-wire-connection portion 41*b* overlap with the fuel tank 8 as an appearance component, when the vehicle 1 is seen in the top-bottom direction that is the viewing direction V3.

<A Case where Component Overlaps with Appearance Component in Plural Viewing Directions>

At least one of the vent valve 41, the suction pump 42, or the pressure sensor 43 may be disposed such that the passage connection portion and the electric-wire-connection portion thereof overlap with at least one appearance component when the vehicle 1 is seen in each of a plurality of viewing directions.

As illustrated in FIG. 8, for example, the suction pump 42 is disposed such that the suction-pump-passage-connection portion 42*a* and the suction-pump-electric-wire-connection portion 42*b* overlap with the front cover 21 as an appearance component when the vehicle 1 is seen in the left-right direction that is the viewing direction V1 and the front-rear direction that is the viewing direction V2.

As illustrated in FIG. 8, for example, the suction pump 42 is disposed such that the suction-pump-passage-connection portion 42*a* and the suction-pump-electric-wire-connection portion 42*b* overlap with the front cover 21 as an appearance component when the vehicle 1 is seen in the left-right direction that is the viewing direction V1 and that the suction-pump-passage-connection portion 42*a* and the suction-pump-electric-wire-connection portion 42*b* overlap with the headlight 16 as an appearance component when the vehicle 1 is seen in the front-rear direction that is the viewing direction V2.

The viewing direction in which the passage connection portion and the electric-wire-connection portion of each of the vent valve 41, the suction pump 42, and the pressure sensor 43 overlap an appearance component and the overlapping appearance component are not limited in all the embodiments.

As described above, the vent-valve-passage-connection portion 41*a*, the vent-valve-electric-wire-connection portion 41*b*, the suction-pump-passage-connection portion 42*a*, the suction-pump-electric-wire-connection portion 42*b*, the pressure-sensor-passage-connection portion 43*a*, and the pressure-sensor-electric-wire-connection portion 43*b* are covered with appearance components in at least one viewing direction that is at least one of the top-bottom direction, the front-rear direction, or the left-right direction that are viewing directions when the vehicle 1 is seen from a surrounding of the vehicle 1.

The vent-valve-passage-connection portion 41*a*, the vent-valve-electric-wire-connection portion 41*b*, the suction-pump-passage-connection portion 42*a*, the suction-pump-electric-wire-connection portion 42*b*, the pressure-sensor-passage-connection portion 43*a*, and the pressure-sensor-electric-wire-connection portion 43*b* are located closer to appearance components than the center plane perpendicular to the viewing direction in the vehicle 1 in an upright state.

Thus, the vent-valve-passage-connection portion 41*a*, the vent-valve-electric-wire-connection portion 41*b*, the suction-pump-passage-connection portion 42*a*, the suction-pump-electric-wire-connection portion 42*b*, the pressure-sensor-passage-connection portion 43*a*, and the pressure-sensor-electric-wire-connection portion 43*b* are less likely to be splashed with, for example, rain water during driving of the vehicle 1 and high-pressure wash water during high-pressure vehicle wash. In addition, since the vent valve 41 that opens the vent pipe 34 for introducing outside air Ga is covered with an appearance component, rain water and wash water, for example, are less likely to enter from the vent pipe 34. Accordingly, the vent valve 41, the suction pump 42, and the pressure sensor 43 can be disposed to enhance waterproofness of the vent-valve-passage-connection portion 41*a*, the vent-valve-electric-wire-connection portion 41*b*, the suction-pump-passage-connection portion 42*a*, the suction-pump-electric-wire-connection portion 42*b*, the pressure-sensor-passage-connection portion 43*a*, the pressure-sensor-electric-wire-connection portion 43*b*.

In addition, the electric-wire-connection portions and the passage connection portions of the vent valve 41, the suction pump 42, or the pressure sensor 43 are covered with an appearance component and are disposed close to the appearance component. Thus, the amount of application of ultraviolet radiation included in sunlight can be reduced. Consequently, light fastness of the electric-wire-connection portions and the passage connection portions can be enhanced.

<Variations of Leak Detection Device>

Figure 9:
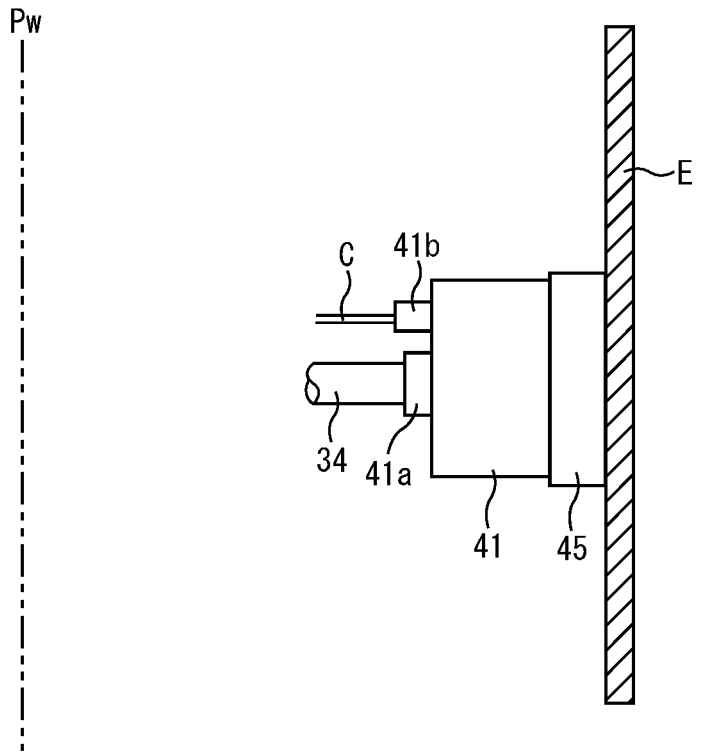
FIG. 9 is a schematic view of the vent valve supported by an appearance component in the evaporative emission system according to the first embodiment.
Figure 10:
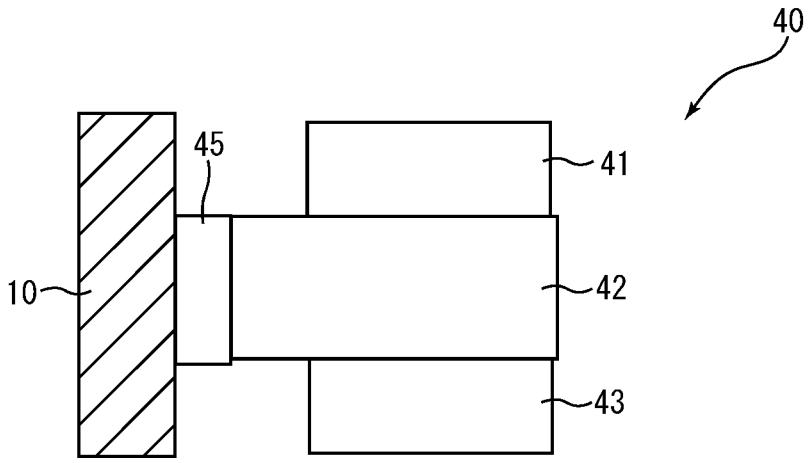
FIG. 10 is a schematic view of the suction pump to which the vent valve and the pressure sensor are coupled in the evaporative emission system according to the first embodiment.
Figure 11:
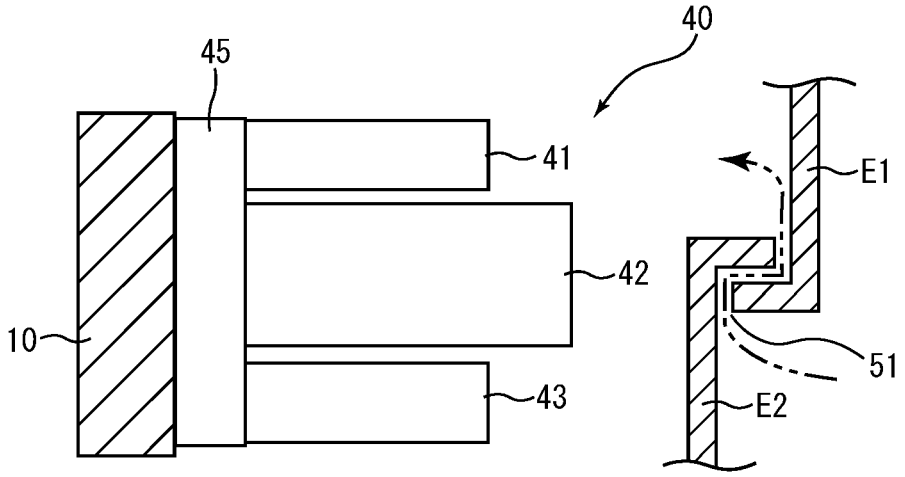
FIG. 11 is a schematic view to which the vent valve and the pressure sensor are coupled through a support member in the evaporative emission system according to the first embodiment.
Figure 12:
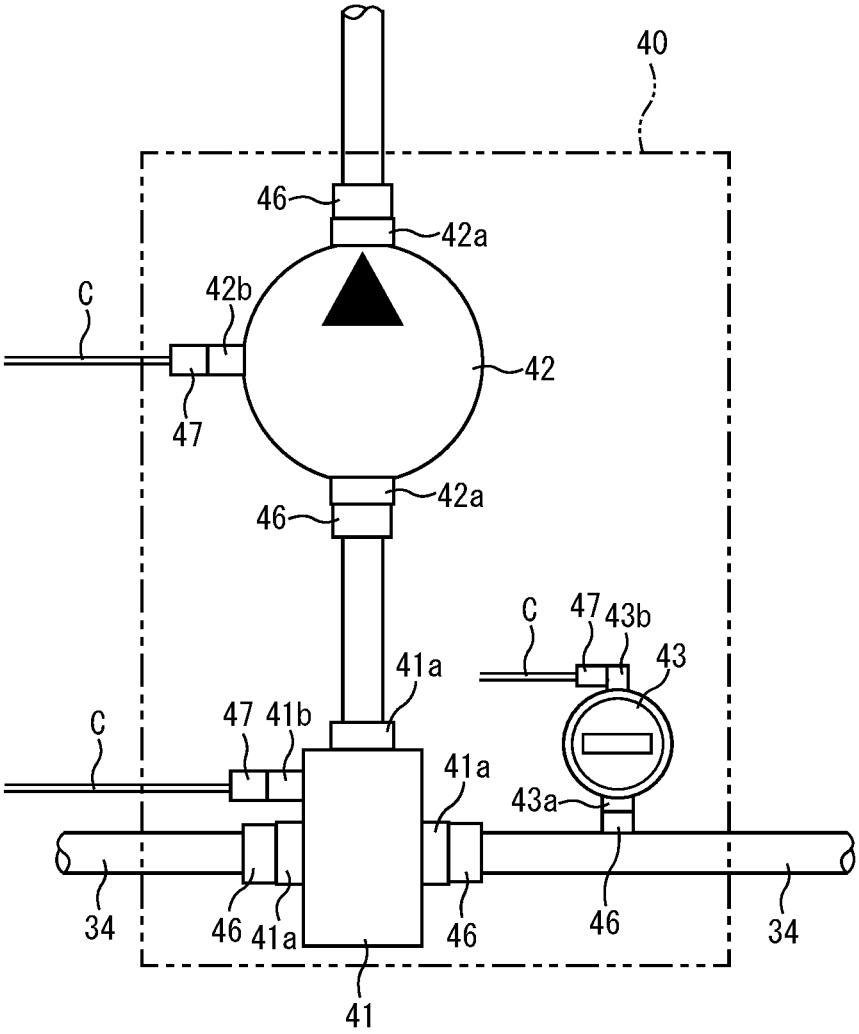
FIG. 12 is a configuration view of hermetic members provided in the passage connection portions of the vent valve, the suction pump, and the pressure sensor and connection terminals provided in the electric-wire-connection portions thereof in the evaporative emission system according to the first embodiment.
Figure 16:
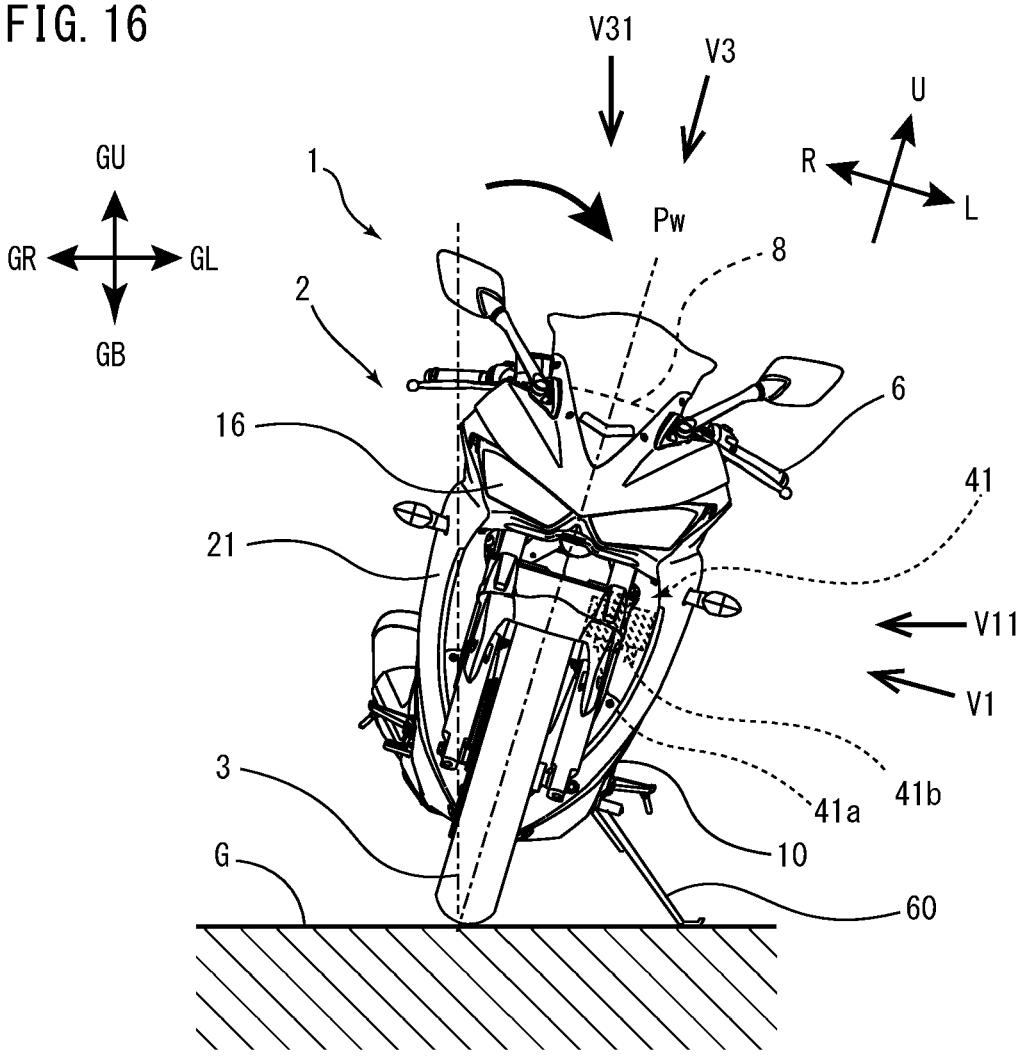
FIG. 16 is a front view of the vehicle illustrating a state where a vent-valve-passage-connection portion and a vent-valve-electric-wire-connection portion are disposed in a lean state of the vehicle.

Then, with reference to FIGS. 9 through 12 and 16, variations of the gas-leak-detection device 40 of the evaporative emission system 30 will be described. FIG. 9 is a schematic view of the vent valve 41 supported by an appearance component E. FIG. 10 is a schematic view of the suction pump 42 to which the vent valve 41 and the pressure sensor 43 are coupled. FIG. 11 are schematic views of the suction pump 42 to which the vent valve 41 and the pressure sensor 43 are coupled through a support member 45. FIG. 12 is a configuration view of hermetic members 46 provided in the passage connection portions of the vent valve 41, the suction pump 42, and the pressure sensor 43 and connection terminals 47 provided in the electric-wire-connection portions. FIG. 16 is a front view of the vehicle 1 illustrating a state where the vent-valve-passage-connection portion 41*a* and the vent-valve-electric-wire-connection portion 41*b* are disposed in a lean state of the vehicle 1.

<Support of Leak Detection Device>

At least one of the vent valve 41, the suction pump 42, or the pressure sensor 43 included in the gas-leak-detection device 40 may be supported by an appearance component with which the passage connection portion and the electric-wire-connection portion overlap when the vehicle 1 is seen in the viewing direction.

As illustrated in FIG. 9, for example, in the vehicle 1, in a case where the vent valve 41 is disposed such that the appearance component E overlaps with the vent-valve-passage-connection portion 41*a* and the vent-valve-electric-wire-connection portion 41*b* when the vehicle 1 is seen in the left-right direction that is the viewing direction V1, the vent valve 41 is coupled to the appearance component E by the support member 45. At this time, the vent valve 41 is supported at a position at which the vent-valve-passage-connection portion 41*a* and the vent-valve-electric-wire-connection portion 41*b* are closer to the appearance component E than the imaginary-lateral-center plane Pw.

The vent valve 41 is disposed closer to the appearance component E when being supported to the appearance component E by the support member 45. Accordingly, the appearance component E can further ensure protection of the vent-valve-passage-connection portion 41*a* and the vent-valve-electric-wire-connection portion 41*b* against, for example, rain water during driving and high-pressure wash water during high-pressure vehicle wash. Accordingly, the vent-valve-passage-connection portion 41*a* and the vent-valve-electric-wire-connection portion 41*b* are less likely to be splashed with, for example, rain water during driving of the vehicle 1 and high-pressure wash water during high-pressure vehicle wash. The same holds for the suction-pump-passage-connection portion 42*a* and the suction-pump-electric-wire-connection portion 42*b* of the suction pump 42 and the pressure-sensor-passage-connection portion 43*a* and the pressure-sensor-electric-wire-connection portion 43*b* of the pressure sensor 43, the suction pump 42 and the pressure sensor 43 supported to the appearance component E. Accordingly, the vent valve 41, the suction pump 42, and the pressure sensor 43 are supported to the appearance component by the support member 45 such that the vent-valve-passage-connection portion 41*a*, the vent-valve-electric-wire-connection portion 41*b*, the suction-pump-passage-connection portion 42*a*, the suction-pump-electric-wire-connection portion 42*b*, the pressure-sensor-passage-connection portion 43*a*, and the pressure-sensor-electric-wire-connection portion 43*b* are disposed closer to the appearance component. As a result, waterproofness thereof can be further enhanced.

At least one of the vent valve 41, the suction pump 42, or the pressure sensor 43 may be supported by the support member 45 to an appearance component different from an appearance component overlapping with the passage connection portion and the electric-wire-connection portion thereof when the vehicle 1 is seen in the viewing direction. At least one of the vent valve 41, the suction pump 42, or the pressure sensor 43 may be supported while being in contact with an appearance component overlapping with the passage connection portion and the electric-wire-connection portion thereof when the vehicle 1 is seen in the viewing direction.

<Combination of Vent Valve, Suction Pump, and Pressure Sensor>

In the gas-leak-detection device 40, at least two of the vent valve 41, the suction pump 42, or the pressure sensor 43 may be integrated.

<Three Components are Integrated>

As illustrated in FIG. 10, in a case where the vent valve 41, the suction pump 42, and the pressure sensor 43 are integrated, one of the vent valve 41, the suction pump 42, or the pressure sensor 43 supported by the vehicle 1 may be coupled to, while being in contact with, at least one of the other components. In this embodiment, the vent valve 41 and the pressure sensor 43 are coupled to the suction pump 42 supported to the frame 10 by the support member 45 with a part of the vent valve 41 and the pressure sensor 43 being in contact with the suction pump 42.

<Three Components are Coupled to One Support Component and Integrated>

As illustrated in FIG. 11, the support member 45 supporting one of the vent valve 41, the suction pump 42, or the pressure sensor 43 may couple the other two components. In this embodiment, the suction pump 42 and the pressure sensor 43 are coupled to the support member 45 supporting the vent valve 41 from the vehicle 1.

<Three Components are Integrated to One Support Member through Coupling Member>

The vent valve 41, the suction pump 42, or the pressure sensor 43 may be coupled to each other by using coupling members. The support member 45 supporting one of the vent valve 41, the suction pump 42, or the pressure sensor 43 may be coupled to the other two components by using coupling members.

<Gap Between Appearance Components>

As illustrated in FIG. 11, the vehicle 1 may include a first-vehicle-body cover E1 and a second-vehicle-body cover E2 as appearance components. For example, the first-vehicle-body cover E1 as a first appearance component and the second-vehicle-body cover E2 as a second appearance component are disposed adjacent to each other. A gap 51 may be partially or entirely formed between the first-vehicle-body cover E1 and the second-vehicle-body cover E2.

Accordingly, it is possible to prevent direct transfer of vibrations occurring in the vehicle 1 during driving from one of the first-vehicle-body cover E1 or the second-vehicle-body cover E2 to the other. As a result, damage of the first-vehicle-body cover E1 and the second-vehicle-body cover E2 can be reduced.

In some cases, water might enter from the outside through the gap 51 in a path indicated by an arrow of a dot-dot-dash line at the inner sides of the first-vehicle-body cover E1 and the second-vehicle-body cover E2. In the case where the gap 51 is formed between the first-vehicle-body cover E1 and the second-vehicle-body cover E2 as described above, the vent valve 41, the suction pump 42, and the pressure sensor 43 are disposed at locations avoiding the gap 51 and covered at least one of the first-vehicle-body cover E1 or the second-vehicle-body cover E2. Accordingly, it is possible to prevent the vent valve 41, the suction pump 42, and the pressure sensor 43 from getting wet with water that has entered the inside of the first-vehicle-body cover E1 and the second-vehicle-body cover E2 from the outside through the gap 51. Thus, even when a gap is present between the first-vehicle-body cover E1 and the second-vehicle-body cover E2, waterproofness of the electric-wire-connection portions and the passage connection portions of the vent valve 41, the suction pump 42, and the pressure sensor 43 can be maintained.

As illustrated in FIG. 11, the vent valve 41, the suction pump 42, and the pressure sensor 43 are supported by the frame 10 through the support member 45.

As illustrated in FIG. 11, the vent valve 41, the suction pump 42, and the pressure sensor 43 are disposed in the frame 10 separated from the first-vehicle-body cover E1 and the second-vehicle-body cover E2 so that it is possible to prevent the vent valve 41, the suction pump 42, and the pressure sensor 43 from getting get with water.

<Leaning-Self-Standing State by Side Stand>

In FIG. 16, arrow GU represents an upward direction with respect to a horizontal ground G. In FIG. 16, arrow GB represents a downward direction with respect to the horizontal ground G. That is, the arrow GU coincides with the upward direction of the vehicle 1 in the upright state, and arrow GB coincides with the downward direction of the vehicle 1 in the upright state. Arrow GL in the drawing represents the leftward direction of the vehicle 1 in the upright state. Arrow GR in the drawing represents the rightward direction of the vehicle 1 in the upright state.

As illustrated in FIG. 16, the vehicle 1 includes a side stand 60 for causing the vehicle 1 to stand by itself in a lean state while the vehicle 1 is stopped. The side stand 60 is attached to the left side of the frame 10 of the vehicle body 2. While the vehicle 1 is caused to stand by itself in the lean state by using the side stand 60, the side stand 60 supports the body frame 10 such that the body frame 10 leans leftward with respect to the vertical line.

In the state where the vehicle 1 stands by itself by using the side stand 60, the vent valve 41 is disposed in the vehicle 1 such that the front cover 21 as an appearance component overlaps with the vent-valve-passage-connection portion 41*a* and the vent-valve-electric-wire-connection portion 41*b* when the vehicle 1 is seen in the left-right direction that is the viewing direction V11.

In the state where the vehicle 1 stands by itself by using the side stand 60, the vent valve 41 is disposed in the vehicle 1 such that the fuel tank 8 as an appearance component overlaps with the vent-valve-passage-connection portion 41*a* and the vent-valve-electric-wire-connection portion 41*b* when the vehicle 1 is seen in the top-bottom direction that is the viewing direction V31.

As described above, the arrangement described above is also employed not only for the viewing directions V1 and V3 with respect to the vehicle 1 in the upright state but also for the viewing directions V11 and V31 with respect to the vehicle 1 in a lean state. Accordingly, it is possible to prevent the vent valve 41, the suction pump 42, and the pressure sensor 43 from getting wet with water.

<Hermetic Member of Passage Connection Portion and Connection Terminal of Electric-Wire-Connection Portion>

The gas passage may be connected through the hermetic members 46 to the passage connection portions of the vent valve 41, the suction pump 42, and the pressure sensor 43 included in the leak detection device 40. The electric wires C may be connected to the electric-wire-connection portions of the vent valve 41, the suction pump 42, or the pressure sensor 43 through the connection terminals 47.

As illustrated in FIG. 12, the vent-valve-passage-connection portion 41*a*, the suction-pump-passage-connection portion 42*a*, and the pressure-sensor-passage-connection portion 43*a* include the hermetic members 46 for suppressing entering of liquid. The hermetic members 46 are, for example, gaskets of. fluorocarbon resin. The vent pipe 34 is connected to the vent-valve-passage-connection portion 41*a* by using the hermetic member 46. The vent valve 41 is connected to the suction-pump-passage-connection portion 42*a* by using the hermetic member 46. The pressure-sensor-passage-connection portion 43*a* is connected to the vent pipe 34 by using the hermetic member 46. Accordingly, waterproofness and air tightness of the vent-valve-passage-connection portion 41*a*, the suction-pump-passage-connection portion 42*a*, and the pressure-sensor-passage-connection portion 43*a* can be further enhanced by using the hermetic members 46.

The vent-valve-electric-wire-connection portion 41*b*, the suction-pump-electric-wire-connection portion 42*b*, and the pressure-sensor-electric-wire-connection portion 43*b* include the connection terminals 47 for suppressing entering of liquid. The electric wires C are connected to the vent-valve-electric-wire-connection portion 41*b*, the suction-pump-electric-wire-connection portion 42*b*, and the pressure-sensor-electric-wire-connection portion 43*b* by using the connection terminals 47. Accordingly, waterproofness of the vent-valve-electric-wire-connection portion 41*b*, the suction-pump-electric-wire-connection portion 42*b*, and the pressure-sensor-electric-wire-connection portion 43*b* can be further enhanced by using the connection terminals 47.

Second Embodiment

<Configuration of Leak Detection Device of Forced-Negative-Pressure Type>

Figure 13:
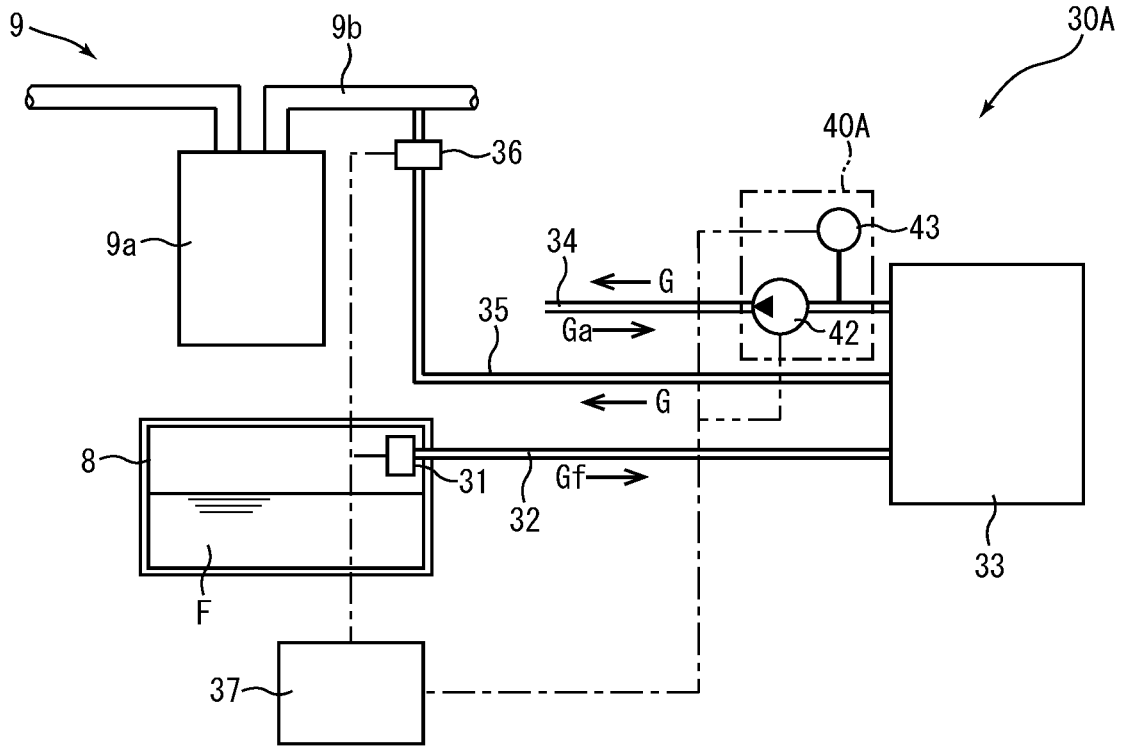
FIG. 13 is a schematic configuration view of an evaporative emission system according to a second embodiment of the present teaching.

Then, with reference to FIG. 13, description will be given on a leak detection device 40A included in an evaporative emission system 30A as a second embodiment of an evaporative emission system mounted on the vehicle 1 according to the present teaching. FIG. 13 is a schematic configuration view of the evaporative emission system 30A mounted on the vehicle 1 according to the embodiment. Note that in the following embodiment, specific description will be omitted for the same points as those in the embodiments described above, and different points will be mainly described.

As illustrated in FIG. 13, the evaporative emission system 30A includes the gas-leak-detection device 40A. The leak detection device 40A is a gas-leak-detection device of a forced-negative-pressure type that forcibly changes a pressure in a gas passage of the evaporative emission system 30A to a negative pressure by using a suction pump 42. The gas-leak-detection device 40A includes, as well as a canister 33, a suction pump 42 and a pressure sensor 43 that are components for a leak test of a gas G from the evaporative emission system 30A.

The suction pump 42 is disposed in a vent pipe 34. The suction pump 42 can suck the gas G in the gas passage through the vent pipe 34. While the suction pump 42 is stopped, the gas passage is in a state where outside air Ga that has passed through the suction pump 42 flows into the gas passage. While the suction pump 42 is operated, the gas G in the gas passage is discharged to the air by the suction pump 42, and thus, the gas passage is in a state where outside air Ga does not flow into the gas passage through the suction pump 42. Thus, the evaporative emission system 30A can introduce the outside air Ga into the gas passage including the canister 33 by stopping the suction pump 42. That is, the suction pump 42 can switch the vent pipe 34 between a closed state in which no outside air Ga flows into the canister 33 and an open state in which outside air Ga flows into the canister 33.

The suction pump 42 included in the gas-leak-detection device 40A is connected to a casing or a canister support member of the canister 33 by a suction-pump-connection member. Alternatively, the suction pump 42 is connected while being in contact with the casing or the canister support member. At least a part of the suction pump 42 may be disposed in the casing. The suction pump 42 may be included in a part of the casing.

<Leak Detection of Evaporative Emission System>

In the case of detecting leakage of a gas G from the evaporative emission system 30A, a control device 37 switches a shut-off valve 31 and a purge control valve 36 to the closed state. Next, the control device 37 sucks the gas G in the gas passage by the suction pump 42 and discharges the gas G into the air from the vent pipe 34. At this time, no outside air Ga flows into the gas passage from the vent pipe 34. The control device 37 measures a pressure in the gas passage by the pressure sensor 43. If the measured value of the pressure sensor 43 is a reference value or more, the control device 37 determines that the gas G can leak from the gas passage.

The gas-leak-detection device 40A is mounted on the vehicle 1 in a state where the canister 33 and the suction pump 42 integrated with the canister 33 maintain a relative distance. Thus, it is possible to mount the gas-leak-detection device 40 on the vehicle 1 to maintain a weight balance of the vehicle 1 and concentrate a mass.

Third Embodiment

<Configuration of Leak-Detection Device of Natural-Negative-Pressure Type>

Figure 14:
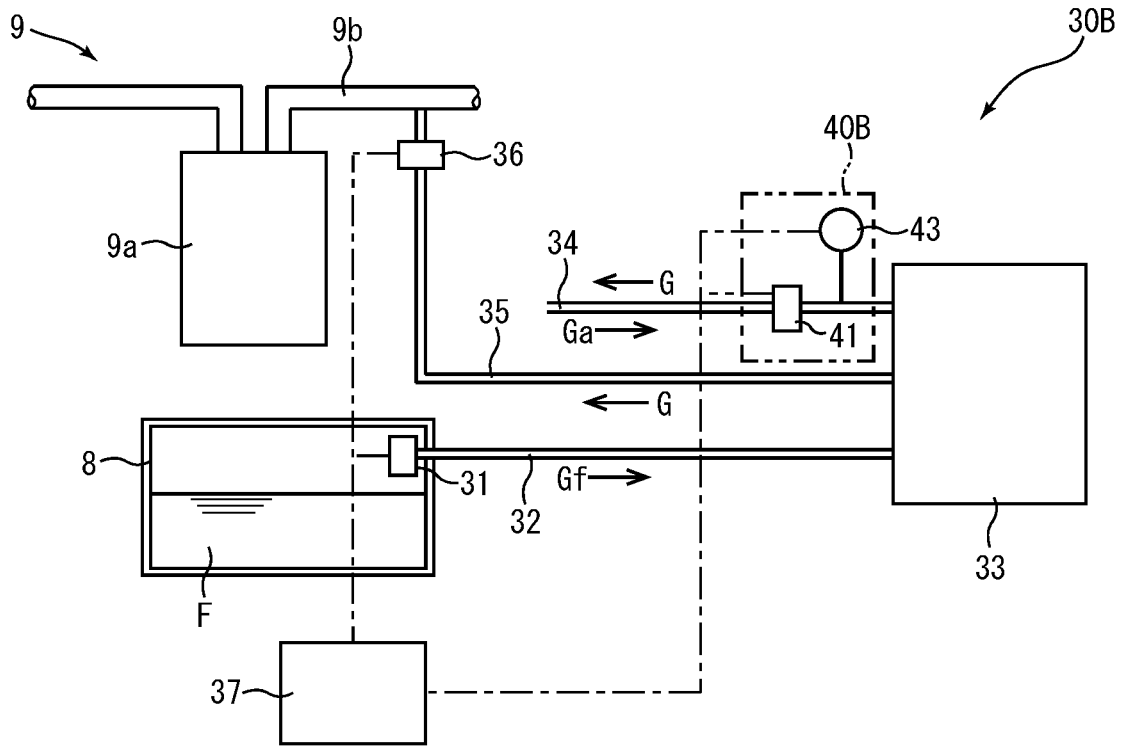
FIG. 14 is a schematic configuration view of an evaporative emission system according to a third embodiment of the present teaching.

Then, with reference to FIG. 14, description will be given on a gas-leak-detection device 40B included in an evaporative emission system 30B as a third embodiment of an evaporative emission system mounted on the vehicle 1 according to the present teaching. FIG. 14 is a schematic configuration view of the evaporative emission system 30B mounted on the vehicle 1 according to the embodiment.

As illustrated in FIG. 14, the evaporative emission system 30B includes the gas-leak-detection device 40B. The gas-leak-detection device 40B is a leak detection device of a natural-negative-pressure type that changes a pressure in a gas passage in the evaporative emission system 30B to a negative pressure by using thermal expansion and thermal contraction of evaporation fuel Gf in a fuel tank 8. The leak detection device 40B includes, as well as a canister 33, a vent valve 41 and a pressure sensor 43 that are components for a leak test of a gas G from the evaporative emission system 30B.

The vent valve 41 included in the gas-leak-detection device 40B is connected to a casing or a canister support member of the canister 33 by a vent-valve-connection member. Alternatively, the vent valve 41 is connected while being in contact with the casing or the canister support member. The vent valve 41 may be included in a part of the casing. At least a part of the vent valve 41 may be disposed in the casing.

<Leak Detection of Evaporative Emission System>

In the case of detecting leakage of a gas G from the evaporative emission system 30B, a control device 37 switches a shut-off valve 31 to an open state. In addition, the control device 37 switches the vent valve 41 and a purge control valve 36 to a closed state. Then, the control device 37 measures a pressure in the gas passage by the pressure sensor 43. In addition, the control device 37 measures a temperature in the fuel tank 8 with an unillustrated thermometer. The control device 37 determines whether there is a possibility of leakage of a gas G from the gas passage based on variations of temperature of the fuel tank 8 and variations of pressure in the gas passage.

OTHER EMBODIMENTS

In the first embodiment, each of the vent valve 41, the suction pump 42, and the pressure sensor 43 is disposed such that an appearance component overlaps with the electric-wire-connection portion and the passage connection portion when seen in the viewing direction in the vehicle 1. At this time, the position and posture of each of the vent valve 41, the suction pump 42, and the pressure sensor 43 with respect to the appearance component are not limited.

In the first embodiment, at least two of the vent valve 41, the suction pump 42, or the pressure sensor 43 are integrated. At this time, orientations and coupling positions of the vent valve 41, the suction pump 42, and the pressure sensor 43 are not limited.

In the first embodiment, the vent valve 41, the suction pump 42, and the pressure sensor 43 are integrated with the canister 33. However, it is sufficient that at least one of the vent valve 41, the suction pump 42, or the pressure sensor 43 is integrated with the canister 33.

In the first embodiment, the canister 33 may not be one casing, and may be divided into two or more casings.

In the first embodiment, the canister 33 is coupled to a component constituting the vehicle 1. At this time, orientation of the canister 33 with respect to the vehicle 1 and a coupling position in the canister 33 are not limited.

In the first embodiment, the vent valve 41, the suction pump 42, or the pressure sensor 43 is coupled to the canister 33. At this time, the orientation and position of the vent valve 41, the suction pump 42, or the pressure sensor 43 coupled to the canister 33 with respect to the canister 33 are not limited.

In the first embodiment, the vent valve 41, the suction pump 42, and the pressure sensor 43 may be coupled to the casing or a canister support member by the same coupling member. The vent valve 41, the suction pump 42, and the pressure sensor 43 may be coupled to the casing or the canister support member while being integrated.

In the first embodiment, the suction pump 42 can be switched by the vent valve 41 provided in the vent pipe 34 between a state where a gas G in the gas passage can be sucked and a state where the gas G in the gas passage cannot be sucked. However, if the suction pump 42 includes a shut-off valve dedicated to the suction pump, the suction pump 42 may be provided in any one of the first purge pipe 32, the canister 33, the vent pipe 34, or the second purge pipe 35. The suction pump 42 may also be provided in the vent value 34 closer to the air than the vent valve 41.

In the first embodiment, the gap 51 is formed between the first-vehicle-body cover E1 and the second-vehicle-body cover E2. Alternatively, no gap is formed between the first-vehicle-body cover and the second-vehicle-body cover.

In the first embodiment, the vehicle 1 includes the side stand 60. Alternatively, the vehicle may not include the side stand 60.

The embodiments of the present teaching have been described above, but the embodiments are merely examples for carrying out the present teaching. Thus, the present teaching is not limited to the embodiments, and the embodiments may be modified as necessary within a range not departing from the gist of the invention.

REFERENCE SIGNS LIST

1 vehicle
2 vehicle body
3 front wheel
4 rear wheel
5 vehicle body cover
6 bar handle
7 seat
8 fuel tank
9 power unit
9*a* engine
9*b* intake pipe
10 frame
11 head pipe
12 main frame
13 seat rail
14 rear arm
15 meter
16 headlight
17 taillight
21 front cover
22 side cover
23 rear cover
30, 30A, 30B evaporative emission system
31 shut-off valve
32 first purge pipe
33 canister
34 vent pipe
35 second purge pipe
36 purge control valve
37 control device
40, 40A, 40B gas-leak-detection device
41 vent valve
41*a* vent-valve-passage-connection portion
41*b* vent-valve-electric-wire-connection portion
42 suction pump
42*a* suction-pump-passage-connection portion
42*b* suction-pump-electric-wire-connection portion
43 pressure sensor
43*a* pressure-sensor-passage-connection portion
43*b* pressure-sensor-electric-wire-connection portion
45 support member
46 hermetic member
47 connection terminal
V1, V2, V3 viewing direction

The invention claimed is:

1. A straddled vehicle comprising:

a plurality of appearance components constituting appearance of the straddled vehicle;

a front wheel;

a rear wheel;

a bar handle configured to steer the front wheel;

an engine configured to drive the front wheel or the rear wheel, the engine having an intake passage;

a fuel tank configured to store fuel to be supplied to the engine;

an evaporative emission system including a canister, and a gas passage that includes an outside-air-introduction passage, the evaporative emission system being configured to collect evaporation fuel generated in the fuel tank using the canister, to introduce outside air into the canister from the outside-air-introduction passage, and to discharge the collected evaporation fuel and the introduced outside air from the canister into the intake passage of the engine;

a pressure sensor configured to measure a pressure in the gas passage, in which a gas including at least one of the evaporation fuel or the outside air flows; and at least one of an electric vent valve or an electric suction pump, the electric vent valve being configured to switch between a closed state in which the outside-air-introduction passage is closed and an open state in which the outside-air-introduction passage is open, the electric suction pump being configured to suck the gas in the gas passage, wherein each of said at least one of the vent valve or the suction pump and the pressure sensor includes an electric-wire-connection portion to which an electric wire for supplying electric power is connected, and a passage connection portion to which the gas passage is connected, each of said at least one of the vent valve or the suction pump and the pressure sensor is disposed in the straddled vehicle such that the electric-wire-connection portion and the passage connection portion overlap with at least one of the plurality of appearance components when the straddled vehicle is seen in at least one viewing direction that is at least one of a left-right direction, a front-rear direction, or a top-bottom direction, of the straddled vehicle, and the electric-wire-connection portion and the passage connection portion are located closer to said at least one appearance component overlapping with the electric-wire-connection portion and the passage connection portion than a center plane perpendicular to said at least one viewing direction when the straddled vehicle is in an upright state, wherein the center plane is one of an imaginary-lateral-center plane that is an imaginary vertical plane including a center of the bar handle in the left-right direction and being perpendicular to the left-right direction, an imaginary-longitudinal-center plane that is an imaginary vertical plane including a center in the front-rear direction between a front end of the front wheel and a rear end of the rear wheel and being perpendicular to the front-rear direction, or an imaginary-vertical-center plane that is an imaginary horizontal plane including a center in the top-bottom direction between an upper end of the bar handle and a lower end of the front wheel and being perpendicular to the top-bottom direction.

2. The straddled vehicle according to claim 1, wherein the plurality of appearance components include a first appearance component and a second appearance component, and the first appearance component and the second appearance component are disposed such that a gap is formed between the first appearance component and the second appearance component.

3. The straddled vehicle according to claim 1, further comprising a side stand configured to support the straddled vehicle such that the straddled vehicle stands by itself in a lean state, wherein each of said at least one of the vent valve or the suction pump and the pressure sensor is disposed in the straddled vehicle such that the electric-wire-connection portion and the passage connection portion overlap with said at least one of the plurality of appearance components when the straddled vehicle is seen in said at least one viewing direction in a state where the straddled vehicle stands by itself using the side stand.

4. The straddled vehicle according to claim 1, wherein at least one of the vent valve, the suction pump, or the pressure sensor is supported by at least one of the plurality of appearance components via a support member.

5. The straddled vehicle according to claim 1, wherein the electric-wire-connection portion is connected to the electric wire via a connection terminal configured to suppress entering of liquid, and the passage connection portion is connected to the gas passage via a hermetic member configured to suppress entering of liquid.

6. The straddled vehicle according to claim 1, wherein in a case where the straddled vehicle includes the vent valve, the pressure sensor measures the pressure in the gas passage when the outside-air-introduction passage is closed by the vent valve, in a case where the straddled vehicle includes the suction pump and the suction pump is disposed in the outside-air-introduction passage, the suction pump sucks the gas in the gas passage and the pressure sensor measures the pressure in the gas passage, and in a case where the straddled vehicle includes the vent valve and the suction pump, the suction pump sucks the gas in the gas passage, the pressure sensor measures the pressure in the gas passage, so as to detect leakage of the gas from the evaporative emission system when the outside-air-introduction passage is closed by the vent valve.

* * * * *